US011097411B2

(12) United States Patent
Hayes

(10) Patent No.: US 11,097,411 B2
(45) Date of Patent: Aug. 24, 2021

(54) ERGONOMETRIC UTILITY HANDLE

(71) Applicant: Riccardo Hayes, St. Louis, MO (US)

(72) Inventor: Riccardo Hayes, St. Louis, MO (US)

( * ) Notice: Subject to any disclaimer, the term of this patent is extended or adjusted under 35 U.S.C. 154(b) by 266 days.

(21) Appl. No.: 16/423,973

(22) Filed: May 28, 2019

(65) Prior Publication Data

US 2019/0308311 A1 Oct. 10, 2019

Related U.S. Application Data

(62) Division of application No. 15/073,102, filed on Mar. 17, 2016, now Pat. No. 10,300,592.

(60) Provisional application No. 62/134,990, filed on Mar. 18, 2015.

(51) Int. Cl.

| | |
|---|---|
| ***B25G 1/10*** | (2006.01) |
| ***B25G 3/36*** | (2006.01) |
| ***A46B 17/02*** | (2006.01) |
| ***A46B 9/02*** | (2006.01) |
| ***A46B 5/00*** | (2006.01) |
| ***A46B 5/02*** | (2006.01) |

(52) U.S. Cl.

CPC ..... *B25G 1/102* (2013.01); *A46B 5/0095* (2013.01); *A46B 5/021* (2013.01); *A46B 9/025* (2013.01); *A46B 17/02* (2013.01); *B25G 3/36* (2013.01); *A46B 2200/202* (2013.01)

(58) Field of Classification Search

CPC ..... A46B 5/0095; A46B 5/021; A46B 9/025; A46B 5/026; B25G 1/102

See application file for complete search history.

(56) References Cited

U.S. PATENT DOCUMENTS

| | | | | |
|---|---|---|---|---|
| 4,592,109 | A * | 6/1986 | Borea | A46B 5/0095 15/144.1 |
| D426,070 | S | 6/2000 | Wholey | |
| D575,067 | S | 8/2008 | Wholey | |
| D636,605 | S | 4/2011 | Wholey | |
| 9,155,381 | B2 * | 10/2015 | Maslow | B25G 1/102 |
| 2014/0194800 | A1 * | 7/2014 | Green | B62D 1/04 602/21 |

* cited by examiner

*Primary Examiner* — Shay Karls

(74) *Attorney, Agent, or Firm* — Matthews Edwards LLC

(57) ABSTRACT

An ergonometric utility handle having a main body portion having an end that fits in a cupped palm and concavities emanating from the end that lengthwise substantially conformingly receive palm sides of a thumb and at least one finger. The concavities are widely dish shaped or bound and defined by gently sloped surfaces disposed in laterally outwardly spaced relation to the utility object or a mounting element therefor and against which the thumb and finger or fingers can be positioned and pressed to control and exert useful mechanical advantage. Additional features include a cantilever element against which a finger can be pressed to enhance control and mechanical advantage, an ability to remove and reorient a utility object, such as to reverse the diagonal cut of a brush tip, and an ability to attach an extension in one or more ways.

20 Claims, 23 Drawing Sheets

ERGONOMETRIC UTILITY HANDLE

This application is a divisional of patent application Ser. No. 15/073,102, filed Mar. 17, 2016, which application claims the benefit of U.S. Provisional Application No. 62/134,990, filed Mar. 18, 2015.

TECHNICAL FIELD

The invention relates generally to a utility handle for utility objects such as brushes, scrapers, cutters, and the like, having a main body portion having an end sized to be generally conformingly received in a palm of a hand cupped or wrapped partially thereabout, and concavities emanating from the end toward the utility object that lengthwise substantially matingly or conformingly receive the palm sides of a thumb and at least one finger of the hand, the concavities defined and bound by widely dish shaped or gently sloped surfaces spaced laterally outwardly of the utility object and against which the thumb and finger or fingers can be pressed to hold the handle and exert useful mechanical advantage and control over the utility object without force concentrations that can lead to fatigue and soreness. Optional features include a concavity for receiving a finger in cantilever relation to the main body portion for enhancing control and mechanical advantage, and a mounting element that allows easily changing utility objects, e.g., brush heads, etc., and attachment of an extension in one or more ways, for optimizing use for various situations.

BACKGROUND ART

Co-pending patent application Ser. No. 15/073,102, filed Mar. 17, 2016, and U.S. Provisional Application No. 62/134,990, filed Mar. 18, 2015, is incorporated herein by reference in its entirety.

Most handles of utility objects have simple shapes, such as cylinder or rod shapes. Some have a knob opposite the utility object, such as the well known shaving and makeup brushes. Other handles such as many brush handles for applying finishes and coatings, such as, but not limited to, paints, varnishes, lacquers, stains, and the like, may have more complex shapes, such as elongate shapes that are wider adjacent to the brush or other utility object, narrower in a mid-region, and continuing narrowness to the opposite end, or wider at that end. Some may have slightly indented generically shaped receptacles for the thumb and/or fingers.

Particularly found to be lacking or unsatisfactory are common known paint brush handles for applying paints, coatings and finishes, which handles are flat in one dimension, usually along the wide side of a flat brush. The shortcomings when using these brushes arise in part due to the weight of the loaded brush, and/or the force which must be exerted when applying thicker paint or other coatings to get them to transfer to the surface being painted or coated. When applying coatings using these common brushes, the brush ferrule which is also flat or adjacent flat area of the handle is typically held or pinched between the thumb tip and one or more fingertips. Placing the thumb and or fingertips on the ferrule places helps increase the precision that can be achieved, but increased thumb and fingertip pressure is often exerted, such as when following a line or edge, e.g., painting a window sash, door trim, or the like, and when cutting in, that is, wherein a brush is used to apply fresh or new paint or other coating material along a line or edge. The thickness between the flat surfaces of the ferrule or brush handle grasped in this manner is typically the same as the thickness of the brush itself in that dimension, and as a general statement, is typically relatively thin, on the order of 1 inch or less for most common brushes.

A prominent problem resulting from holding brushes in the above described manner, with the thumb and fingertips, particularly when doing precision work for an extended time, is that the fingers eventually becoming fatigued and sore. Because of the flatness of the ferrule and the adjacent handle surfaces, few or no effective alternative holding positions are available to provide relief while allowing the same level of precision. And, because the flat surfaces are generally even or coplanar with the sides of the brush, no mechanical advantage is achieved over the brush, typically necessitating exertion of greater force through the thumb and fingertips than is desirable for long periods of use.

When applying coatings along a long line, e.g., several feet in length, cutting in, and other actions requiring precision, a user will typically have to vary the angular relationship of the hand and arm continuously and/or several times during the required movements, and when doing so holding the flat brush handle or ferrule with the thumb and fingertips, will usually involve concentrating loading conditions in the same regions of the palm side pads of the thumb and fingertips, which has been found to be a major cause of the experienced fatigue. Users also often find that the elongate extended portion of the brush handle can interfere with or distract from their ability to sight along the brush, and with their ability to make the necessary hand, wrist, and arm manipulations to guide the brush along the desired line. As a result, applying coatings for extended periods of time using brushes having the known long flat handles has been found to be cumbersome and uncomfortable.

As another problem, repeated non-application movements while holding the brush mainly with the thumb and fingertips, such as when moving the brush between a bucket or pail containing the paint or coating and a higher or distant surface onto which the paint or coating is to be applied, is also fatiguing.

As a result, extended use of the known flat brush handles, particularly many years of daily use, has been found to be a significant contributing factor in chronic discomfort and physical problems in the hand, wrist, forearm, shoulder, neck, and back. In particular, for the required control for precision applications, e.g., window sash, door, and door jamb painting, holding the flat ferrule of brushes between the thumb and tips of the index, second, and sometimes third and fourth fingers, has been found by many with chronic injuries, including professional painters, to be fatiguing after a just a few hours of use, requiring more frequent rest and accompanying reduction in productivity.

As an additional shortcoming, applying coatings using the known brushes by holding the flat ferrule with the thumb and fingertips has also been found to expose the skin to frequent contact with the paint or other coating, which may be undesirable from the perspective of chemical irritation, exposure, and absorption.

Alternatives to the known traditional brush handle shapes include, for example, those of Wholey U.S. Design Patents D426,070; D575,067; and D636,605, which disclose several shaped handles claimed to have ergonometric properties. The main advantage of these handles appears to be relatively shallow concavities shaped to generally receive the thumb tip or the fingertips of a hand, but the concavities have the same shape on both sides, and are still relatively flat and thin, and some of the handles are in the overall form of a pistol grip wherein the fingers are wrapped around the handle in offset relation to the brush and at a large angle thereto (to the brush filaments), which has been found to be less than desirable. There is also little or no apparent manner of achieving mechanical advantage over the brush head with these handles.

In further regard to precision application of coatings and finishes, when applying to trim, such as window sashes, doors, and door frames, the ability to precisely control and hold the brush at particular angles throughout long brushing or stroking movements produce the best results and it has been found that the placement and orientation of the thumb and fingers about the brush handle or ferrule are important.

It has also been found through the inventor's experiments that if more of the hand can be used, and if different thumb and finger positions are available, including using more of the thumb and fingers lengthwise and also different portions of the thumb and finger pads, force concentrations and stress will be reduced, and it will be easier to utilize different muscles of the wrist, forearm, upper arm, and shoulder in the brushing movements to provide relief. It has also been found that if it is possible to exert mechanical advantage over the brush head, less fatigue and soreness can be experienced if done in a manner that does not require holding the brush handle at a substantial distance from the brush tip.

Still further, it has been found that having a brush or other utility object handle shaped to be intuitively grasped, particularly in a mating fashion with the palm, and palm sides of the thumb and fingers of the hand, while holding the utility object, e.g., brush, in multiple alternative functional positions that facilitate use of additional muscles, would be a desirable feature. This has been found to be particularly desirable if the holding positions can be used to exert mechanical advantage over the brush or other utility object.

Another desirable capability when applying finishes to elevated surfaces, e.g., overhead, would be to easily and conveniently extend one's reach while maintaining the ability to precisely control the brush during long brushing movements.

Thus, what is sought is a utility handle for a utility object that provides one or more of the capabilities and features, and overcomes one or more of the problems and shortcomings, set forth above.

SUMMARY OF THE INVENTION

What is disclosed is an ergonometric utility handle for a utility object that provides one or more of the capabilities and features, and overcomes one or more of the problems and shortcomings, set forth above. As a preferred aspect of the invention, the utility handle has a main body portion having a first end including a mounting element for mounting a utility object extending outwardly in a first direction, and a second end opposite the first end having a bulbous or knobby shape having a size to be generally conformingly received in a palm of a hand cupped or wrapped partially thereabout, with concavities emanating therefrom toward the first end, and thus a utility object when mounted thereon, at spaced locations about the main body portion, one of the concavities being configured for generally conformingly receiving lengthwise the palm side of a thumb of the hand, and at least one concavity being configured for generally conformingly receiving lengthwise the palm side of a finger of the hand, there preferably being two of the concavities configured for receiving fingers.

As one exemplary preferred embodiment, the main body portion has opposite first and second lateral surfaces and a third lateral surface between and angularly related to the first and second lateral surfaces, the lateral surfaces extending generally from the first end to the second end, the first lateral surface including a concavity facing outward in a first lateral direction relative to the first direction and open to the second end and configured to lengthwise generally conformingly receive a palm side of a thumb of a hand cupped or wrapped about the second end. The second lateral surface has at least one concavity facing outward in a second lateral direction opposite the first lateral direction and extending longitudinally generally toward the first end, configured to lengthwise generally conformingly receive a palm side of a finger of the hand cupped or wrapped about the second end. The third lateral surface has a concavity facing outward in a third lateral direction angularly related to the first and second lateral directions and is sufficiently large to receive at least a tip of another finger of the hand. At least a substantial portion of the concavities are bound and defined by gently sloped laterally outwardly facing surfaces spaced laterally outwardly of the mounting element and against which the thumb and finger or fingers of the hand when cupped or wrapped partially about the second end can be pressed to exert a force with mechanical advantage over the mounting element, and thus over a utility object such as a brush, scraper, cutter, or the like, when mounted thereon.

As a variant, the main body portion can be customized for either right hand or left hand use, e.g., asymmetrical, with the second lateral surface having elongate concavities configured to lengthwise generally conformingly receive palm sides of two or three fingers of the hand cupped or wrapped about the second end.

As an attendant advantage of the lengthwise conformance of the concavities to the thumb and fingers, respectively, it provides substantially greater surface area of contact along the length of the thumb and fingers for enhanced support when holding the handle, and exerting motive forces thereagainst, and thus reduce force or stress concentrations on those portions, and the hand and related anatomy, generally, compared to the prior known handles, particularly known flat brush handles. As an attendant advantage of the widely dished or gently tapered surfaces of the concavities, they allow positioning the thumb and finger in a range of sideward positions, and at different angles of contact, within the respective concavities to vary the surfaces of the palm sides of the thumb and/or fingers used for contact and thus vary the locations of pressure and compression on the skin surfaces, joints, and nerves, and to change blood flow within the thumb and fingers, and relieve or reduce onset of stiffness, fatigue and/or pain, and they allow better aligning the thumb and/or fingers for exerting desired forces against the handle for holding and moving it. In this latter regard, it has been observed that by pressing the thumb and/or finger or fingers against opposite dished or sloped surfaces of a concavity at the greater lateral distances from the utility object possible with the handle of the invention, a useful mechanical advantage is achieved over the utility object, e.g., brush, via essentially a moment arm through the handle that facilitates flow and transfer of coating or finish materials, e.g., paint, varnish, to the surface being coated with less effort and fatigue. This effect has been found to be most evident and beneficial with thicker or more viscous coatings.

As another variant, the second end of the main body portion can comprise an enlarged bulbous protrusion, that blindingly tapers in the first direction into the concavities of the first and second surfaces, so that the thumb and fingers will grasp the main body portion in a bent form conforming to the profile shape of the bulbous protrusion and all extending generally in the first direction.

As another preferred aspect of the invention, the concavity of the first lateral surface is substantially wider than the thumb across its palm side, as a non-limiting example, at least 1.5 times and preferably 3 or 4 times the thumb width, to provide a wide range of alternative positions sidewardly, and also a range of angular orientations for the thumb relative to the first direction, to achieve desired mechanical advantage and best fit for a variety of users and hand sizes, as well as user preferences. The widths of the individual concavities of the second and third lateral surfaces are narrower than the concavity for the thumb, but are each preferably at least sufficiently wider across the extent of the dish shape or opposite tapered sides than the respective finger received in the concavities, so that some degree of alternative positions are provided, and also so that the fingers can be positioned for achieving best mechanical advantage.

As a further preferred aspect of the invention, the concavities can each have a depth of from about ¼ of the thickness of the thumb or finger to be received therein, up to about the thickness of the received thumb or finger, or so, the greater the distance of the sides or edges of the concavities from the utility object, the greater mechanical advantage that can be achieved. Here, as an illustration, with the configuration of the handle of the invention, it is more easily possible with slight sideward shifts of the finger or fingers to change the location of the contact pressure, and also to exert pressure against the handle in different directions for effecting different movements, e.g., brushing movements in a desired direction. As a non-limiting example, the second lateral surface can include two of the concavities for receiving fingers.

As still another preferred aspect of the invention, the concavities of the second and third surfaces are oriented to emanate from the second end toward the first end and mounting element, so as to extend at least generally in the first direction, although this aspect can be adjusted for a particular application. The bottoms of the concavities can also be straight generally in the first direction, or can be curved or jointed, and can have a topography generally corresponding to the thumb or finger being bent at one or more joints, as desired. In this general regard, it has been found that concavities for the finger that extend or emanate toward the first end in a natural direction of finger orientation are advantageous or comfort and control.

According to another preferred aspect of the invention, for a utility object that is a brush having bendable or curvable filaments or other coating applying elements, having the concavities mainly oriented so as to extend longitudinally at least generally in the first direction, or at a small acute angle to that direction, has been found advantageous. This in combination with the ability to have several alternative thumb and finger positions, enables varying the angle of the thumb and finger or fingers relative to the first direction, and also changing the contact surfaces, and the angle of orientation of the contact surfaces, which combine to further reduce fatigue and soreness as discussed above. A representative application wherein these features are advantageous is when a brush is used to apply a viscous coating such as a paint with movements lateral to the first direction, with pressure applied by the thumb, fingers, and palm of the hand in different directions and manners.

According to another preferred aspect of the invention, as is noted above, the concavities are sized, shaped, and arranged such that the first and second lateral surfaces are asymmetrical, so as to by essentially customized for receiving the thumb (first lateral surface) and the finger or fingers (second lateral surface), as it has been found advantageous to have a larger concavity widthwise (across the thumb) and depthwise (depth relative to adjacent surfaces) for receiving the thumb, and to have a narrower (from side to side across the finger) concavity or concavities for receiving the fingers. The third lateral surface between the first and second lateral surfaces is positioned for receiving the index or pointer finger, which has been found advantageous for configuring the fingers and hand in a natural "handshake" position, useful for comfort and control.

As another preferred aspect, it has been found to be further advantageous for the sloped surfaces of the concavity or concavities for receiving the finger or fingers, to be disposed laterally farther out from a center plane through the main body portion and the mounting element than a utility object mounted thereon so that a force with a useful mechanical advantage can be exerted against the handle and utility object by a finger or fingers along a substantial portion of the length thereof. Thus, as a non-limiting representative example, the edges and adjacent surfaces of the dish shaped concavity or concavities of the second lateral surface can be disposed laterally outwardly of the mounting element and mounted utility element (e.g., brush) by an amount about equal to or even greater than a thickness of the mounting element and associated portion of the utility element in the same direction, to provide the mechanical moment for achieving the mechanical advantage sought.

As another preferred aspect of the invention, the concavity of the third lateral surface has a shape and size to substantially conformingly receive lengthwise a palm side of at least a distal end of another finger generally extended in the first direction has been found to be advantageous to provide a finger to guide the movement of the handle while carefully following a line and when cutting in, and also for providing additional angles and directions in which the handle can be pressed, e.g., for transferring a thick material such as a paint, to a surface being painted. This third surface adds thickness or bulk to the handle, and allows, as a non-limiting example, the index or fore (first) finger to be placed in the concavity of the third surface (between the first and second surfaces), the placement of the thumb in the concavity in the first surface of the main body portion, and one or more of the second through fourth fingers in the concavity or concavities of the second surface facing oppositely of the first surface, all of which alternative positions have been found to be more comfortable and less fatiguing than prior known brush handles.

In addition to its location between the first and second lateral surfaces, the third lateral surface preferably additionally has an overall curved convex shape or a bulbous protuberance, evident when viewed from either the first or second lateral direction, located adjacent to and extending from the concavity or concave portion in a second direction opposite the first direction, away from the first end of the main body and a utility object mounted thereon. This protuberance can have a size and curvature configured to comfortably support the palm surface of the associated finger or fingers, e.g., the index or fore finger, so as to be oriented to extend generally in the first direction, and in a manner for that finger or fingers to support and guide movements of the utility object, e.g., brush, particularly for effecting precision movements of the brush tip. This finger or fingers can also be used to support the brush during movements between a source of the coating and the surface to which it is to be applied. As another attendant advantage here, it has been found that more precise control of movement of the utility object, e.g., brush, knife, scraper, is achieved, with less fatigue and soreness and potential for injury over long periods of use, compared to the known flatter handles.

According to another preferred aspect of the invention, by partially cupped, it is meant that the hand will be closed sufficiently so that the thumb and fingers will extend generally in one direction (which will be the first direction or at only a small acute angle to the first direction), but not pinched together or clenched. As a non-limiting example shape-wise and dimensionally, the main body portion can have an overall rounded profile shape when viewing the opposite first and second lateral surfaces straight on, and a diameter or extent in the first direction of at least about 2-3 inches, so as to fit within the length of an adult person's hand, and an overall width between the opposite first and second surfaces of at least about 1.5 inch, with the concavities arranged so that the handle can be comfortably and intuitively held and gripped or retained by the palm, thumb, and at least one finger of a person's hand when in the desired partially cupped or wrapped configuration.

According to a more particular preferred aspect of the invention, the mounting element includes structure for securely mounting a brush or brush ferrule thereon so as to also extend in the first direction, so that when holding the brush the fingers can be at least generally aligned with the brush filaments or oriented at a small acute angle to that direction. Here, it should be understood that by generally, the fingers of the hand and the direction of the brush can be within a range of angles to each other, e.g., and the concavities can be configured such that any of the thumb or utilized fingers can be received in multiple alternative positions and orientations therein, which provides a variety of effective alternative holding positions and has been found to be key to reducing concentration of pressure in the fingertips and fatigue from holding and using a brush using the fingertips only during long periods of use.

Thus, as an attendant practical advantage, the utility handle can be held in multiple positions by the hand, e.g., mainly by the cupped palm, or mainly with the thumb and one or more of the fingers, and by a combination of both lengthwise or longitudinal conformance with the palm, thumb and fingers, various alternative comfortable and intuitive positions and orientations, with the weight, e.g., a utility object such as a brush when laden with heavy paint, distributed over a larger portion of the hand structure and not in the fingertips as with prior known handle designs.

As more specific examples of advantages of this configuration and capability when used with a brush, the handle can be mainly held in the palm when lifting a heavily laden brush overhead and to other elevated locations, and when reaching, then more finger pressure applied when applying coatings, and even more finger pressure and fingertip pressure applied, if desired, when applying the coatings in a more precise manner, and when used with a smaller brush. The brush can also be held about the ferrule if desired.

Thus, with the above brush handle configuration, the handle can be comfortably held and carried in the cupped palm, e.g., for carrying the brush, including when laden with heavy paint and lifted and manipulated from a downwardly extending orientation to a horizontal or upwardly extending orientation over a distance of as much as several feet, and when executing broad brush strokes and more general movements. The configuration also allows moving the thumb and one or more of the second, third, or fourth fingers, in multiple alternative positions aligned with the wider sides of the brush, so as to essentially grip the handle (using the palm as desired), and the index finger aligned at least generally with the edge of the brush, to effect precisely controlled brush movements for fine detail coatings application. With these brush holding options, the brush can be comfortably and controllably moved in broad brushing movements to apply the coating using the larger flat brush surfaces, or in finer precision brushing movements using those surfaces, or the brush edge, as desired or required for a particular application.

As an optional aspect of the invention, the mounting element can be configured to allow mounting a brush with an angled sash cut extending toward or away from the third surface, as desired or required for a particular application. As another option, the mounting element can also be configured to allow mounting a brush cross-wise or transverse to the first and second surfaces, if desired.

As another optional aspect of the invention, the main body portion can include a cantilever extension extending therefrom generally in the first direction, e.g., from the third surface, in spaced, generally parallel relation to the mounting element. When a utility object, e.g., a brush having a brush ferrule, is mounted, the cantilever extension will be spaced from the ferrule, bounding and defining a gap therebetween configured to receive an edge or lip of a paint bucket or cup for hanging the brush or other utility object. As another option, the cantilever extension can comprise an extension of the third surface and includes an extension of the concavity of that surface, allowing placement of a desired finger or fingers, or the thumb, closer to the application of the coating, for more precise control.

As another option according to the invention, particularly for use with larger brushes, the main body portion has a butt end portion or protrusion extending from a second end generally opposite the mounting element, the butt end portion or protrusion having a contoured shape including concavities or indentations for receiving a palm side of a heel of the thumb and at least one of a palm side or sides of a third and fourth finger, respectively, of a hand when cupped or wrapped about the main body portion of the handle. As non-limiting exemplary parameters, the butt end portion extends at between about an 80 degree angle and about a 130 degree angle to a longitudinal axis extending in the first direction, so that the handle can have an overall generally L- or V-shape. As an attendant advantage of this configuration, it permits supporting and carrying a portion of the weight of the utility object between the heel of the thumb and the heel of the hand and/or proximal portions of any or all of the fingers. This has been found to further distribute loads to other areas of the hand closer to the wrist.

As still another option, the handle of the invention can include one or more internally threaded apertures configured for threadedly receiving a male threaded end of an extension pole having a desired length, to allow use of the handle for applying coatings to normally out of reach surfaces, such as upper regions of walls and ceilings. As non-limiting examples, the main body portion can include one or more threaded apertures for attachment of an extension pole, e.g., in the second end thereof, or butt end portion, extending generally opposite the first direction, generally perpendicular or at a large acute angle or small obtuse angle to the first direction, etc., such that the extension pole can be attached to the handle to extend therefrom in the desired direction. As another alternative, the aperture can be oriented such that the handle will extend laterally or sidewardly relative to an axis of the extension pole. In either instance, the extension pole can be used when desired and removed when not needed.

As still another option, all or a portion of the main body portion can be constructed to be resiliently compressible or yieldable to a limited extent, so as to be slightly squeezably compressible when held in the hand. As a non-limiting example, all or a portion of the main body portion can bound and define a hollow cavity and the first, second, and/or third surfaces be of resiliently flexible material to allow inward yielding to hand pressure. As a non-limiting example the second end of the main body portion can have a generally bulbous shape and be hollow or of a foamed material so as to have a resiliently compressible characteristic under hand pressure.

DETAILED DESCRIPTION OF PREFERRED EMBODIMENTS OF THE INVENTION

Figure 1:
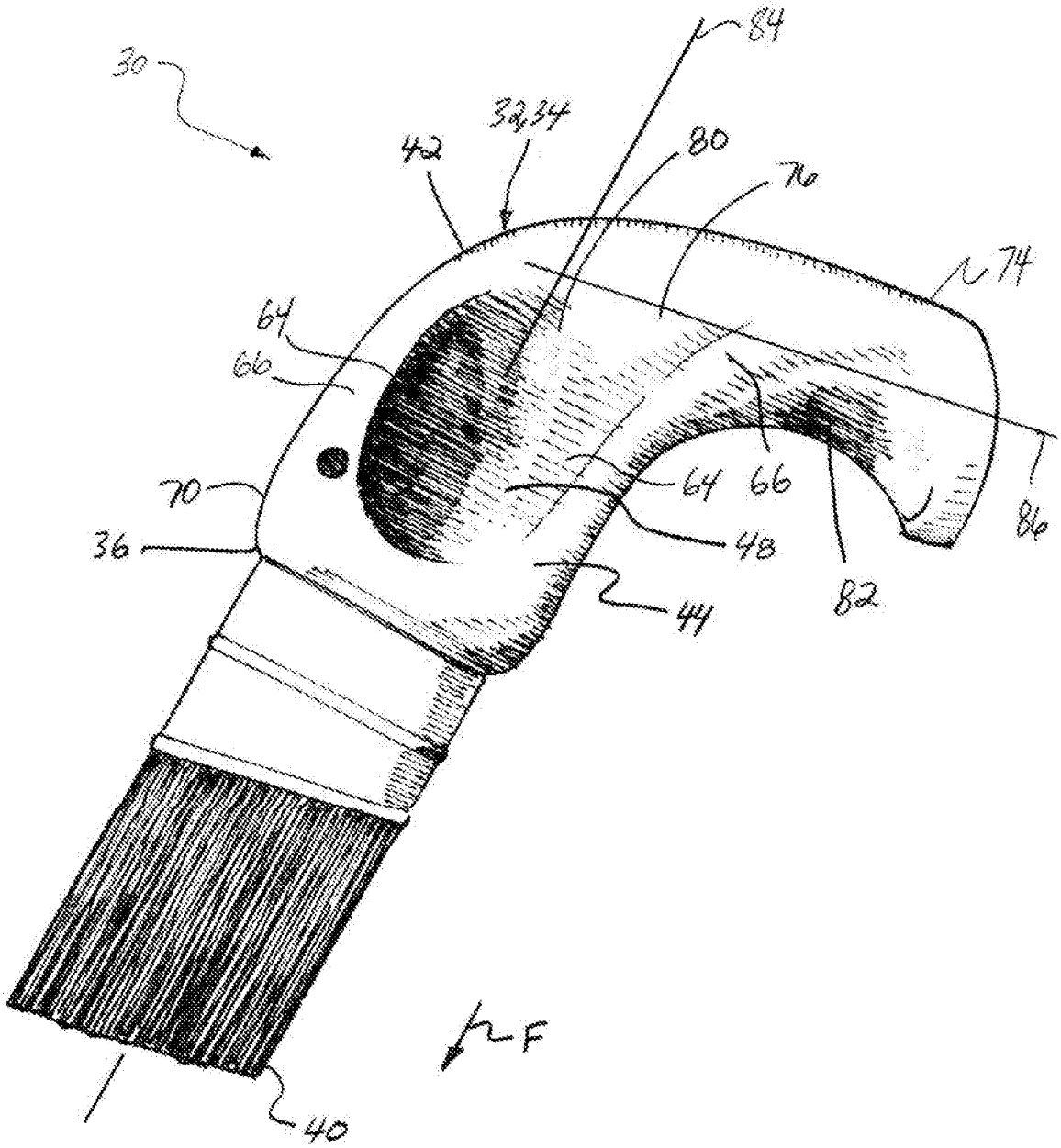
FIG. 1 is a side view of a brush including an ergonometric utility handle constructed and operable according to the teachings of the invention.
Figure 2:
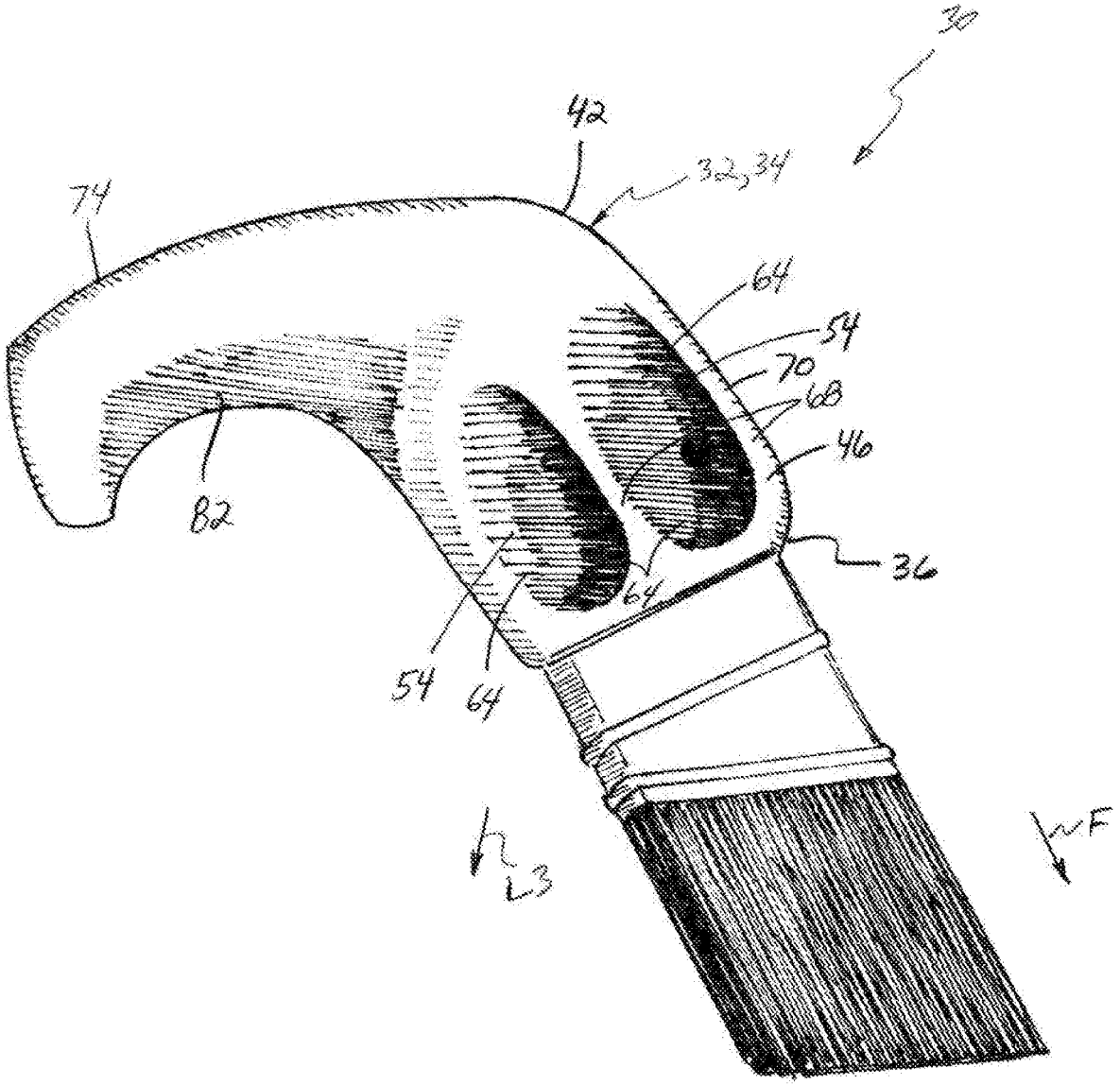
FIG. 2 is a perspective view of the brush.

Referring now to the drawings, in FIGS. 1 through 11, a brush 30 for applying a variety of coatings, including, but not limited to, paints, varnishes, stains, shellacs, and the like, is shown including an embodiment of an ergonometric utility handle 32 constructed and operable according to the teachings of the invention. Ergonometric utility handle 32 has an ergonometric shape and size so as to be capable of being comfortably held in the hand for long periods of time, e.g., several hours during a work day, several days a week, with an enhanced ability to support and exert motive forces against the brush, e.g. for transferring thick or viscous coatings or finishes onto a surface being coated, in a controlled manner.

Utility handle 32 includes a main body portion 34 having an overall three dimensional asymmetrical shape sized for being received and held in the palm of a partially cupped or folded hand wrapped thereabout with the thumb and fingers of the hand generally extending in comfortable supported positions and orientations, toward a functional or first end 36, the palm, thumb, and fingers desirably arranged in about a "handshake" configuration, or one that would typically be used for grasping a door knob in the palm with substantial surface to surface contact (see FIGS. 6A and 6B), not pinching it in just the thumb tip and fingertips and perhaps a small region of the palm as with prior known flat handles. First end 36 has a mounting element 38 (FIG. 3A) for mounting a utility object 40 thereon, which here is shown as a brush head and alternatively as a knife or cutter, to extend outwardly in a first direction, denoted by arrow F.

Figure 4:
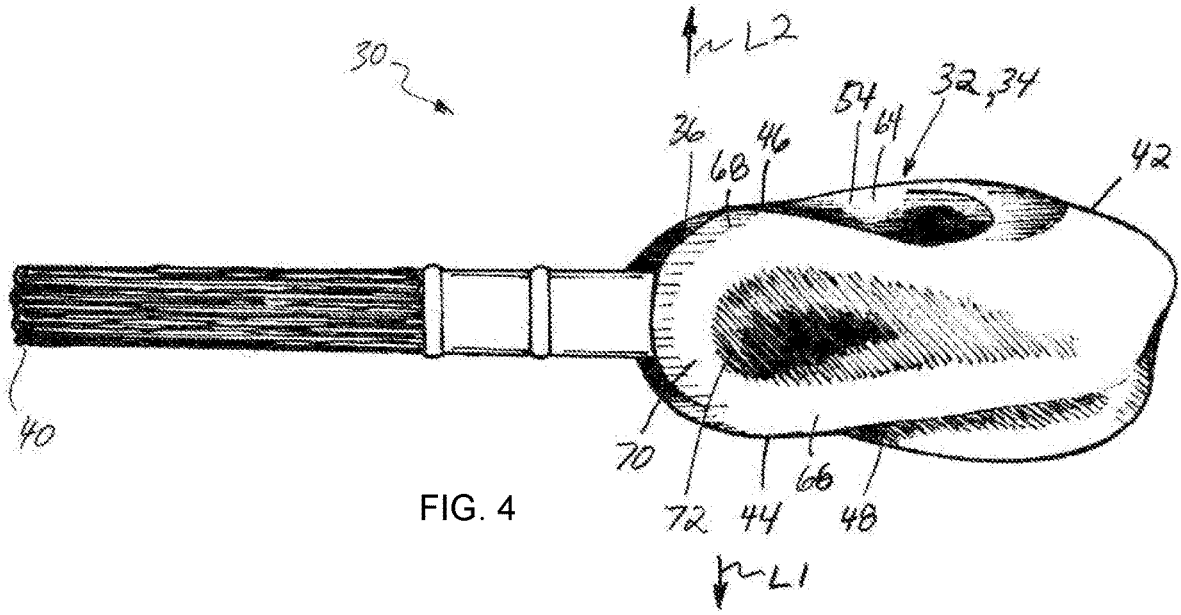
FIG. 4 is a top view of the brush.
Figure 5:
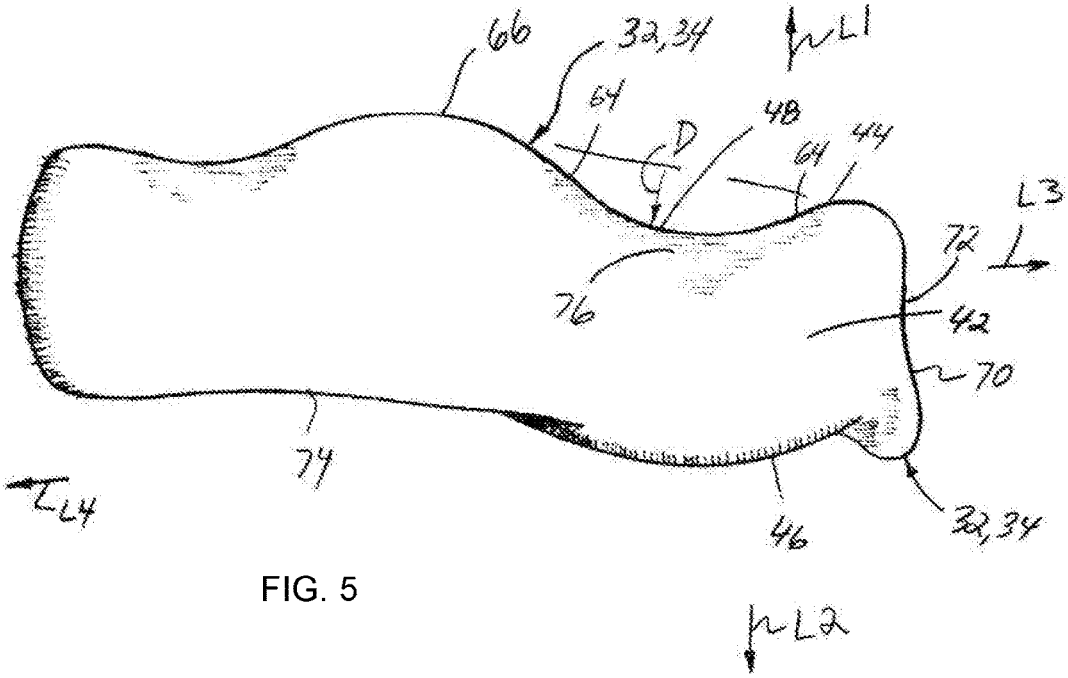
FIG. 5 is an end view of the brush.
Figure 6:
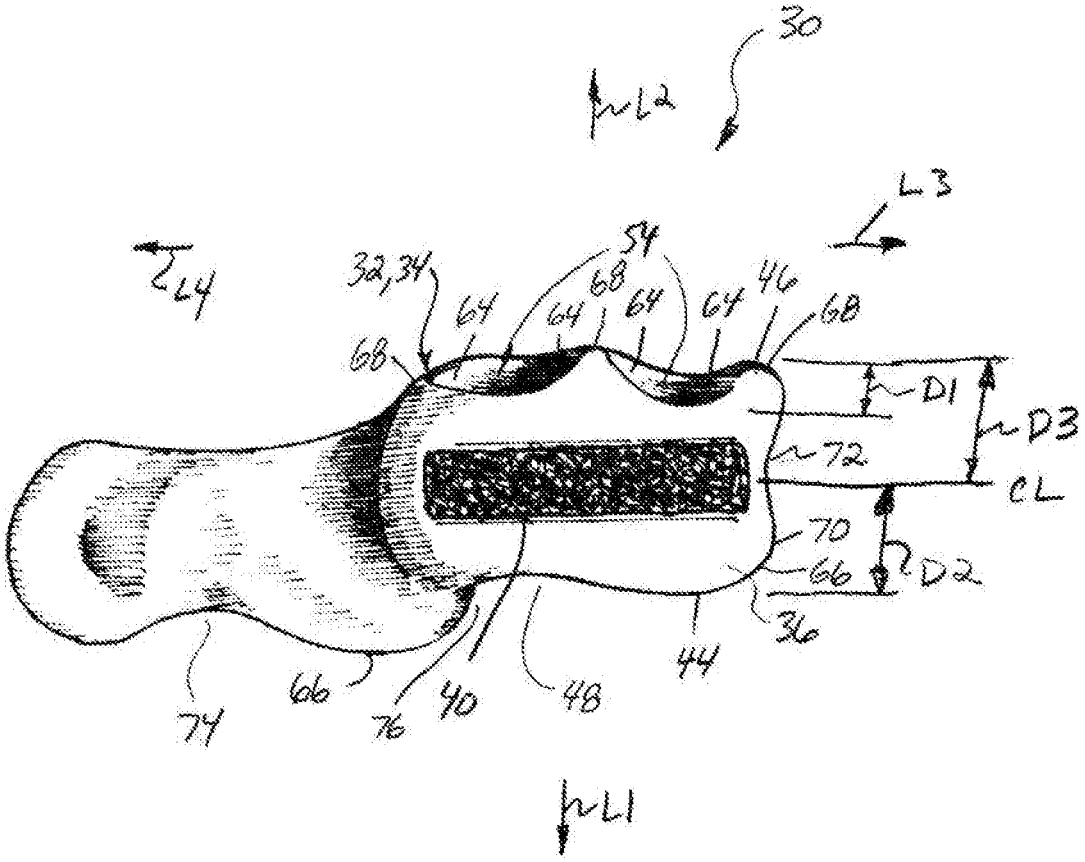
FIG. 6 is another end view of the brush.

Main body portion 34 has a generally bulbous shape second end 42 opposite first end 36 sized to generally conformingly fit in a partially cupped palm of a hand of an intended user. Main body portion 34 has a first lateral surface 44 (FIG. 1) facing laterally outwardly in a first lateral direction L1, and a second lateral surface 46 facing oppositely of first lateral surface 44 in a second lateral direction L2 opposite the first lateral direction, as shown in FIGS. 4, 5, and 6.

Figure 7:
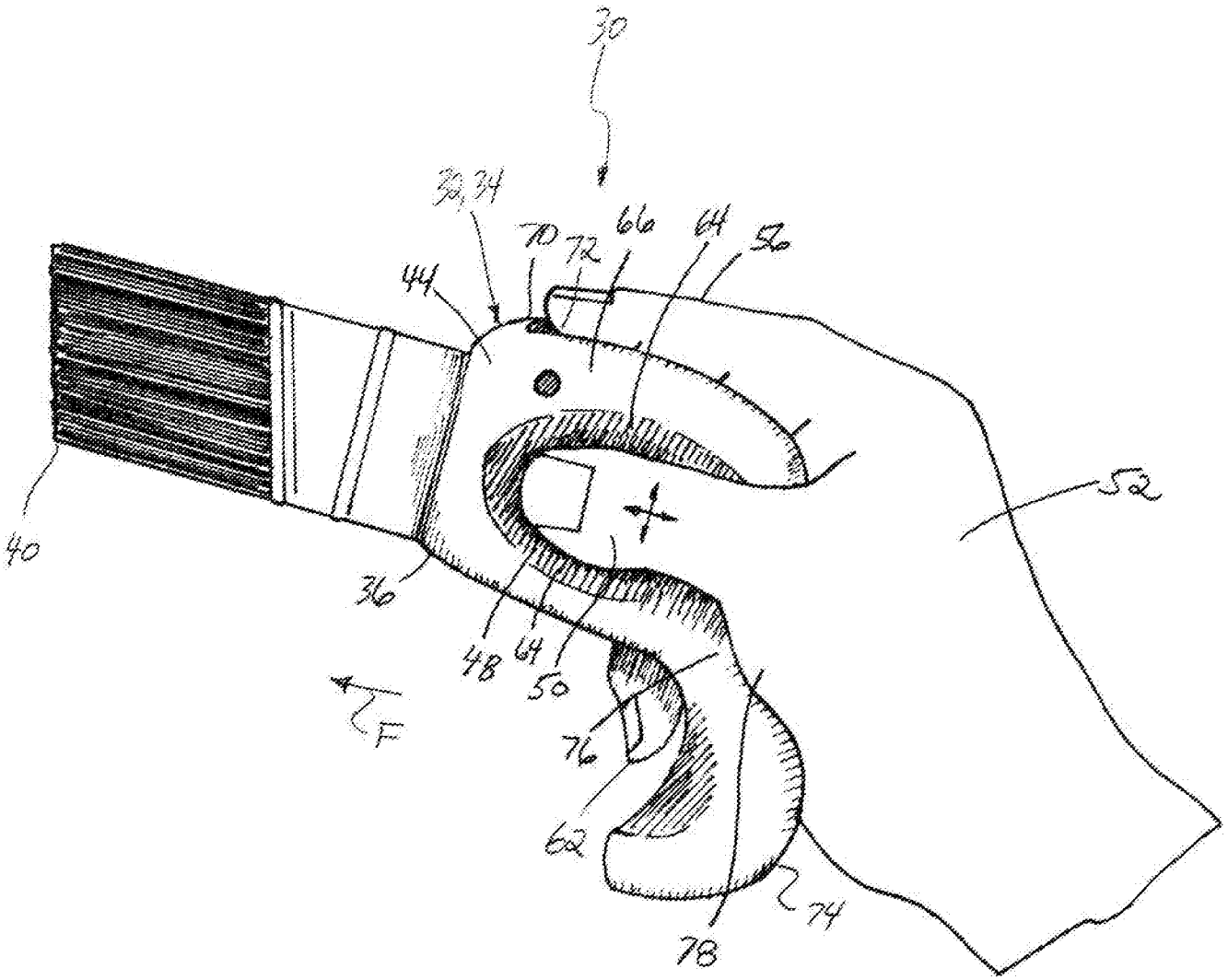
FIG. 7 is another side view of the brush, shown being held in one manner in a hand.
Figure 8:
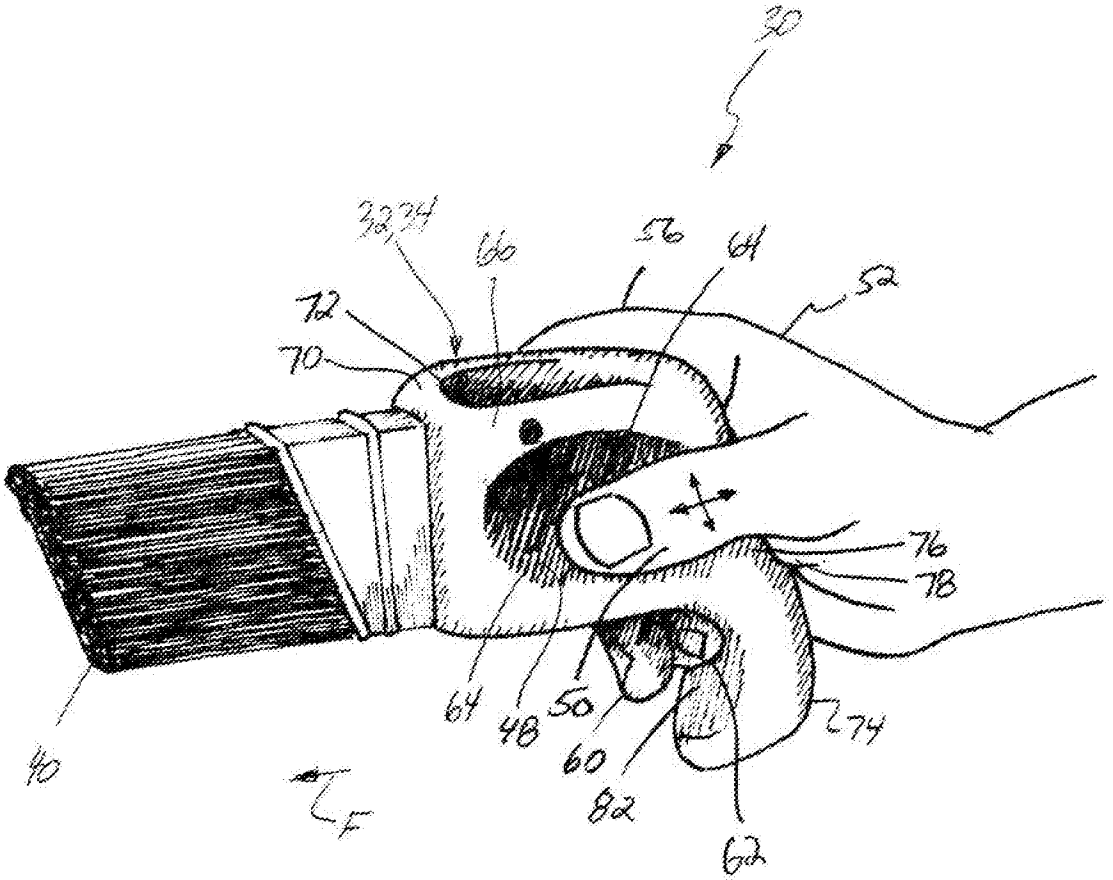
FIG. 8 is another side view the brush shown held in the hand, with the thumb and fore finger of the hand in different positions.
Figure 9:
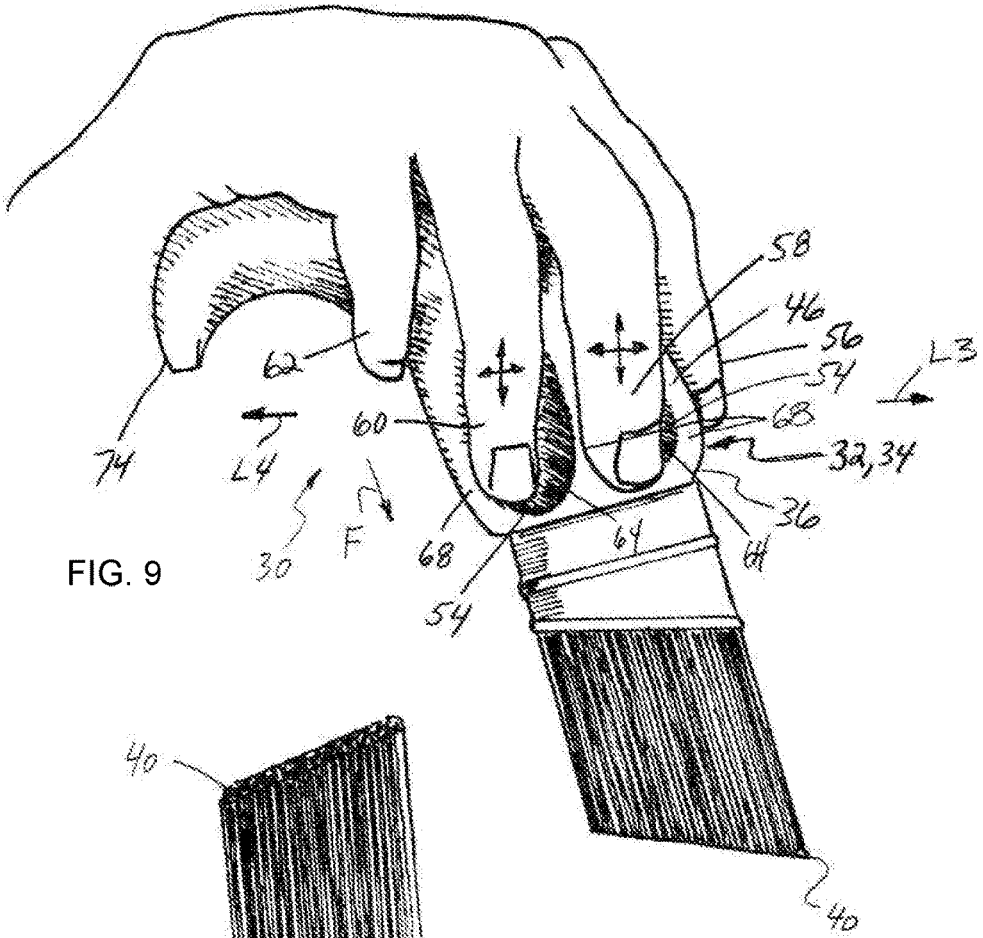
FIG. 9 is still another side view of the brush shown held in the hand in a different orientation.
Figure 10:
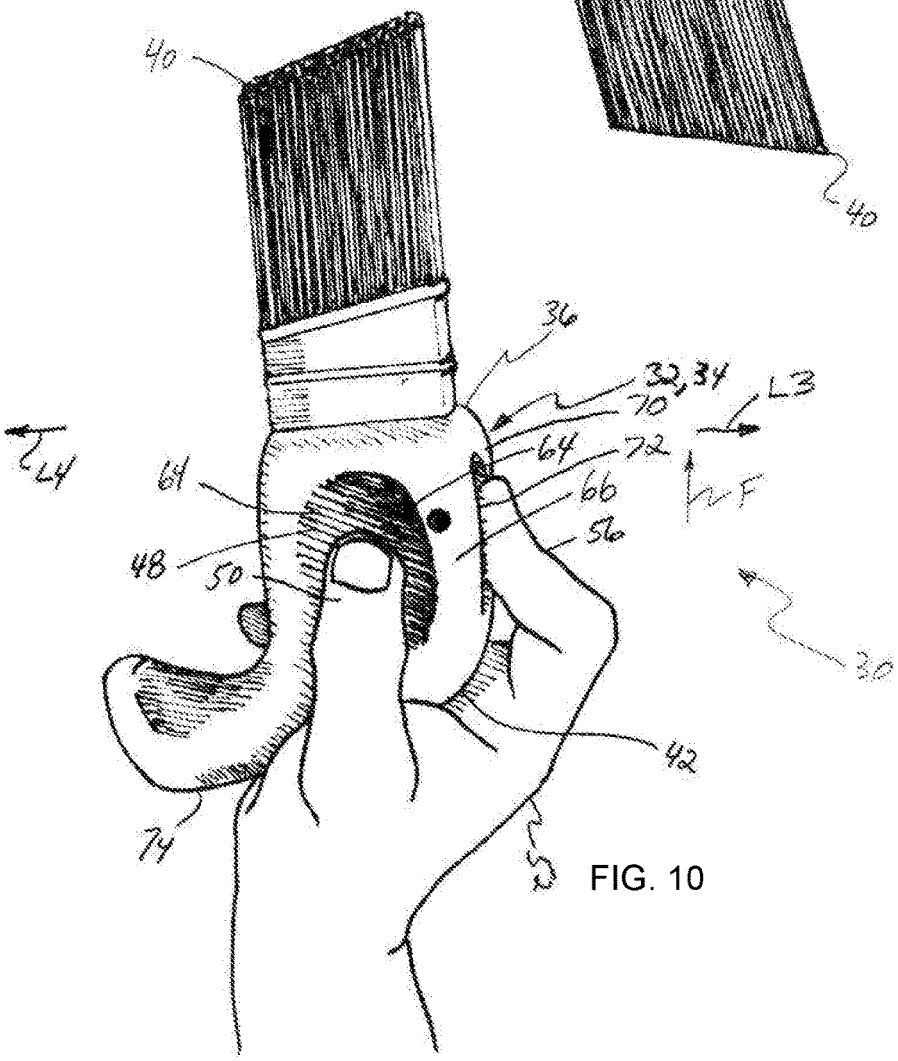
FIG. 10 is still another side view of the brush shown held in the hand in yet a different orientation.

Surfaces 44 and 46 are asymmetrical, first lateral surface 44 including a first concavity 48 facing in the first lateral direction L1 and configured to receive the palm side of a thumb 50 of a hand 52 when cupped or wrapped about second end 42, in generally lengthwise conforming relation, as representatively illustrated in FIGS. 7, 8, and 10; second lateral surface 46 including two second concavities 54 facing in the second lateral direction L2 and configured to receive the palm side of a finger 56, 58, 60, or 62 of hand 52, so as to extend at least generally in the first direction F toward the utility object 40, as generally illustrated in FIG. 9.

Figure 11:
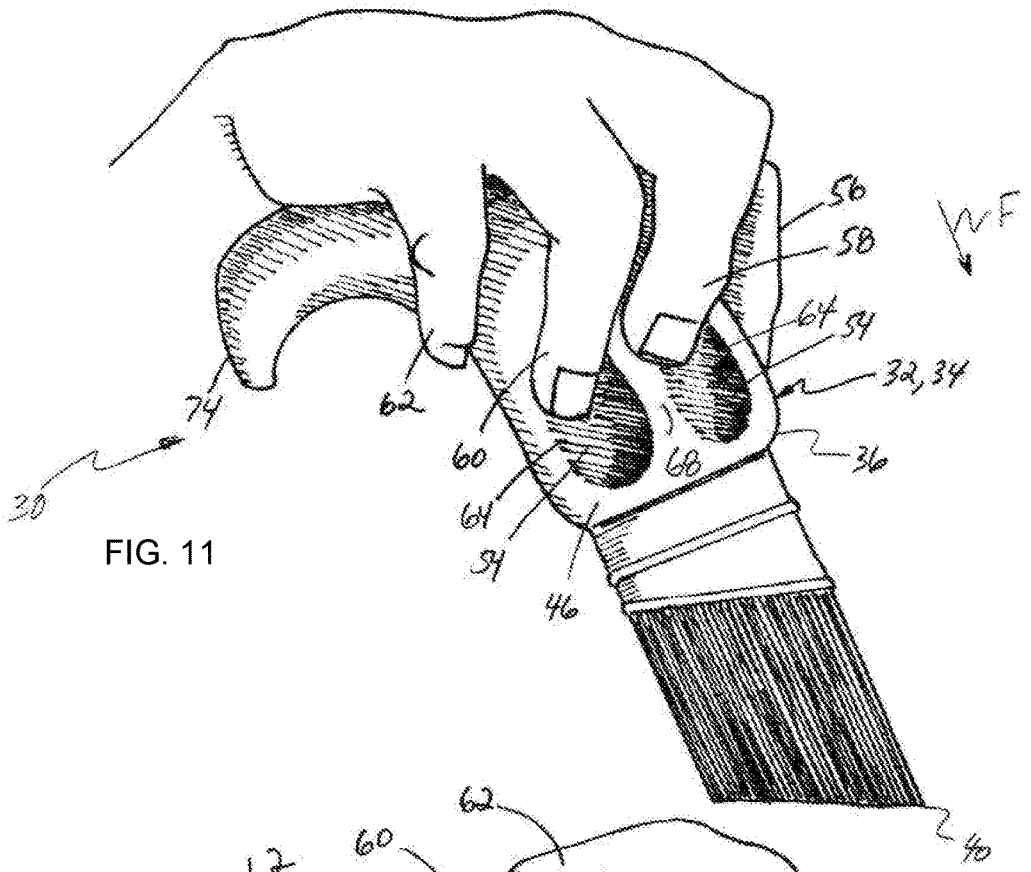
FIG. 11 is still another side view of the brush shown held in another orientation.
Figure 20:
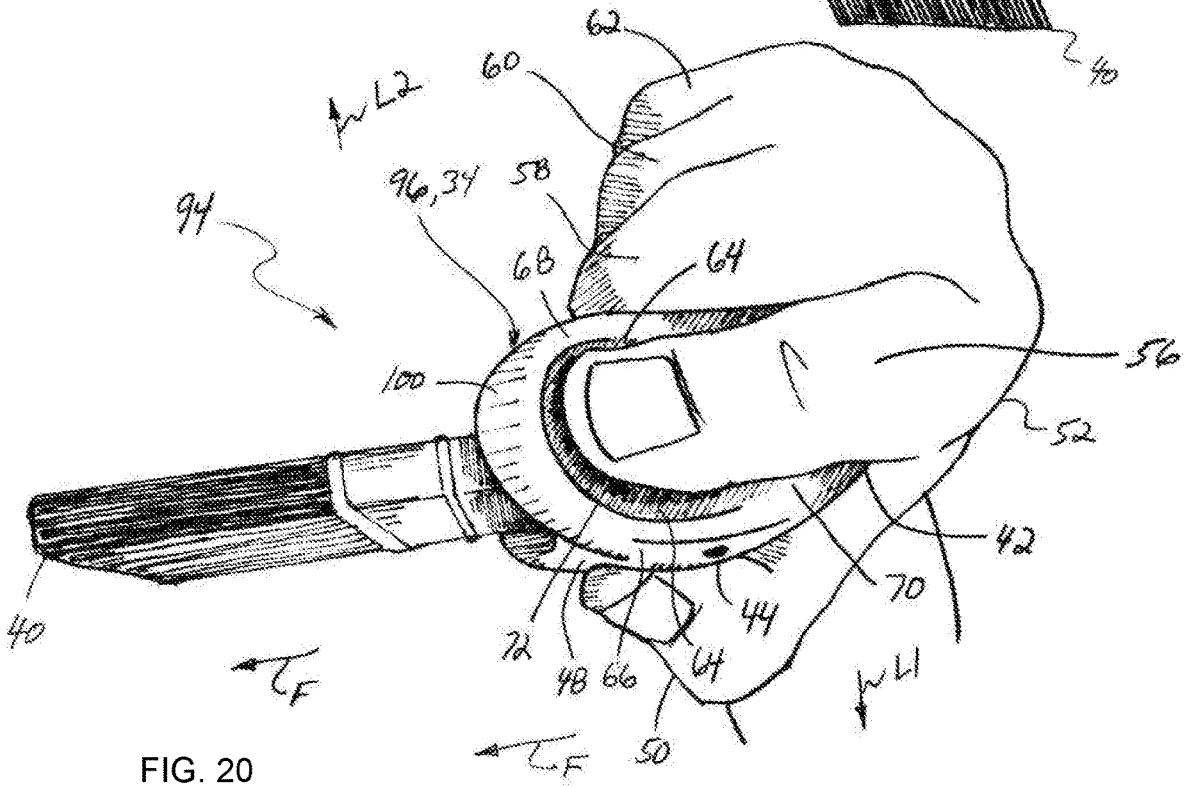
FIG. 20 is a top view of the brush show held in the hand, with a fore finger of the hand disposed in a concavity of the handle.
Figure 12:
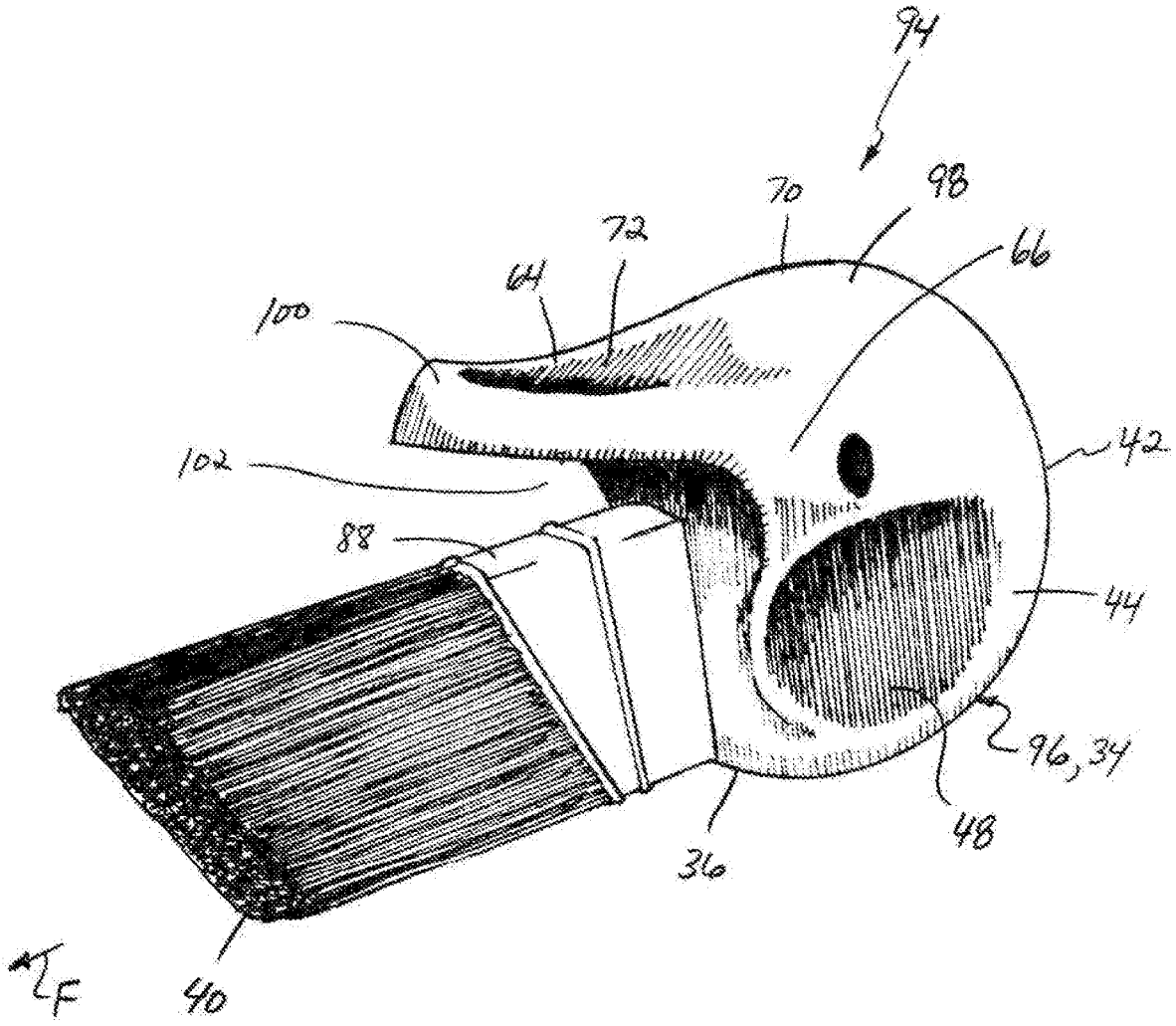
FIG. 12 is a perspective view of a brush including another utility handle constructed and operable according to the teachings of the invention.
Figure 13:
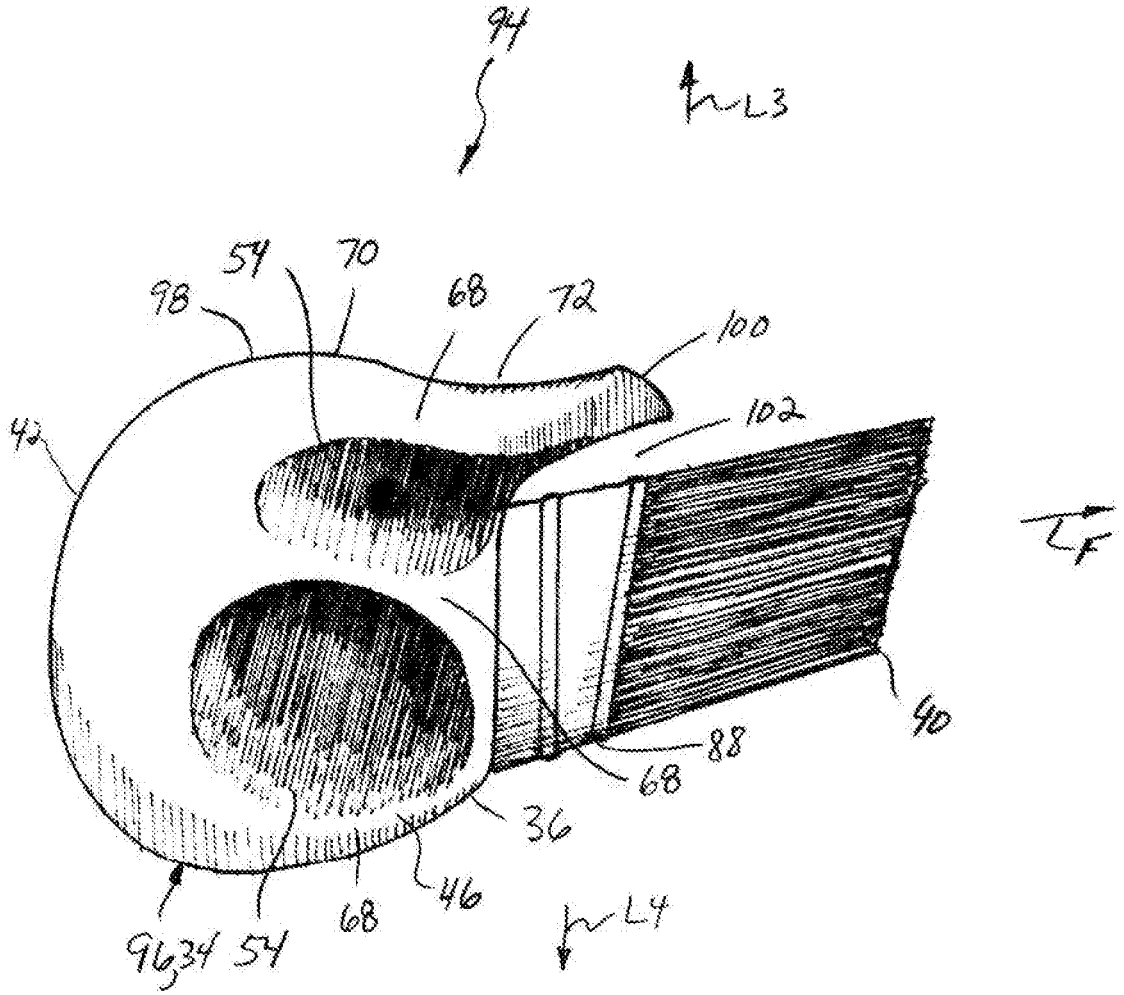
FIG. 13 is a side view of the brush of FIG. 12.
Figure 14:
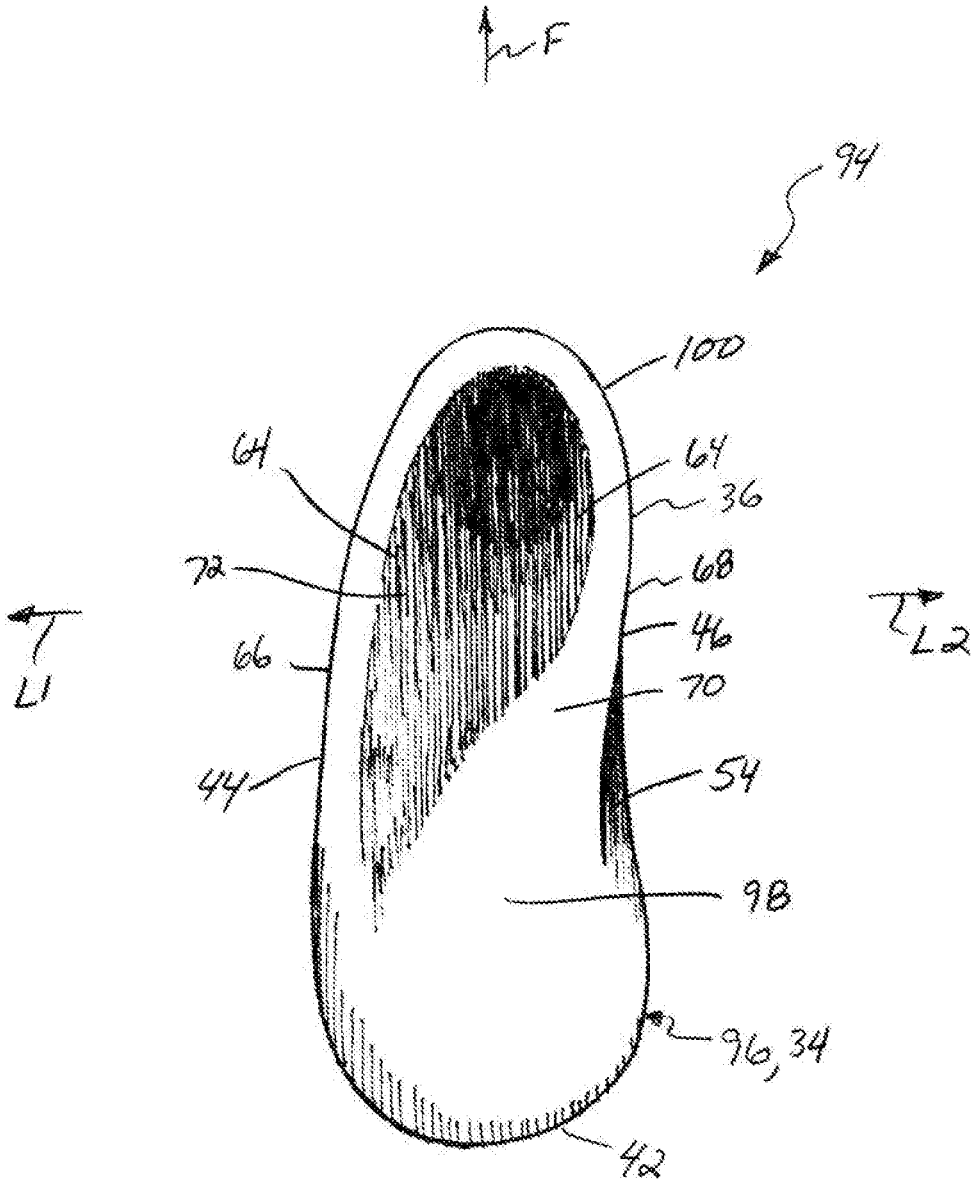
FIG. 14 is a top view of the brush.
Figure 15:
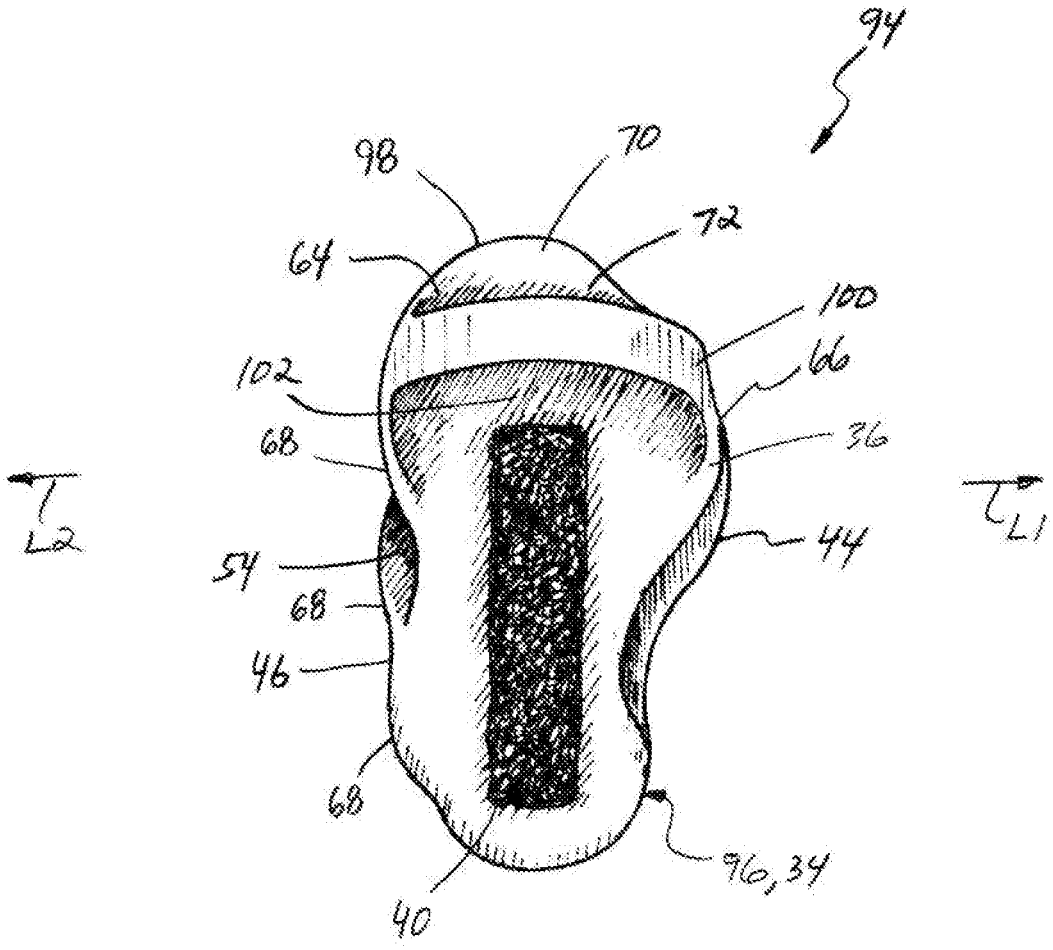
FIG. 15 is an end view of the brush.
Figure 16:
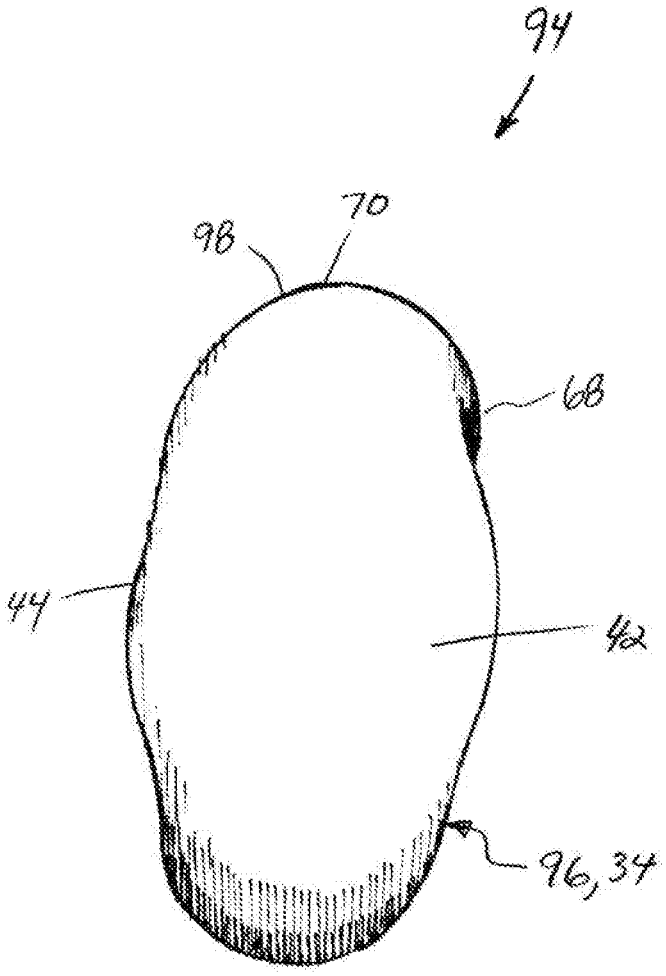
FIG. 16 is another end view of the brush.
Figure 17:
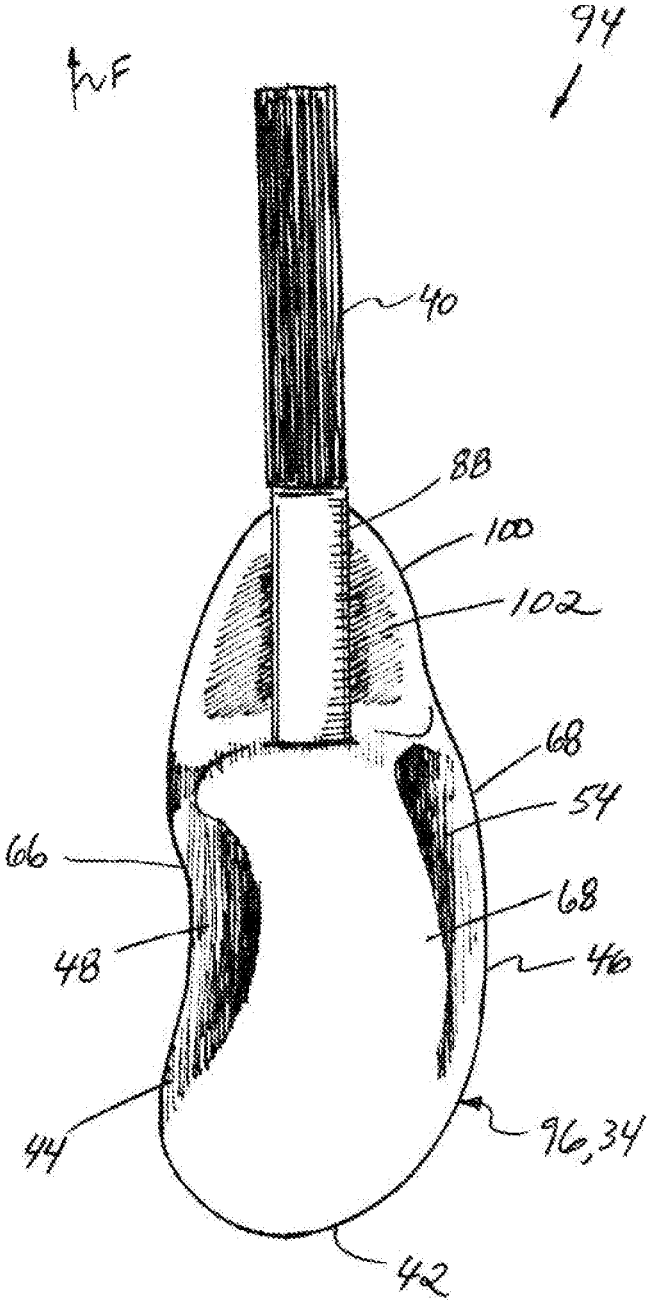
FIG. 17 is a bottom view of the brush.
Figure 18:
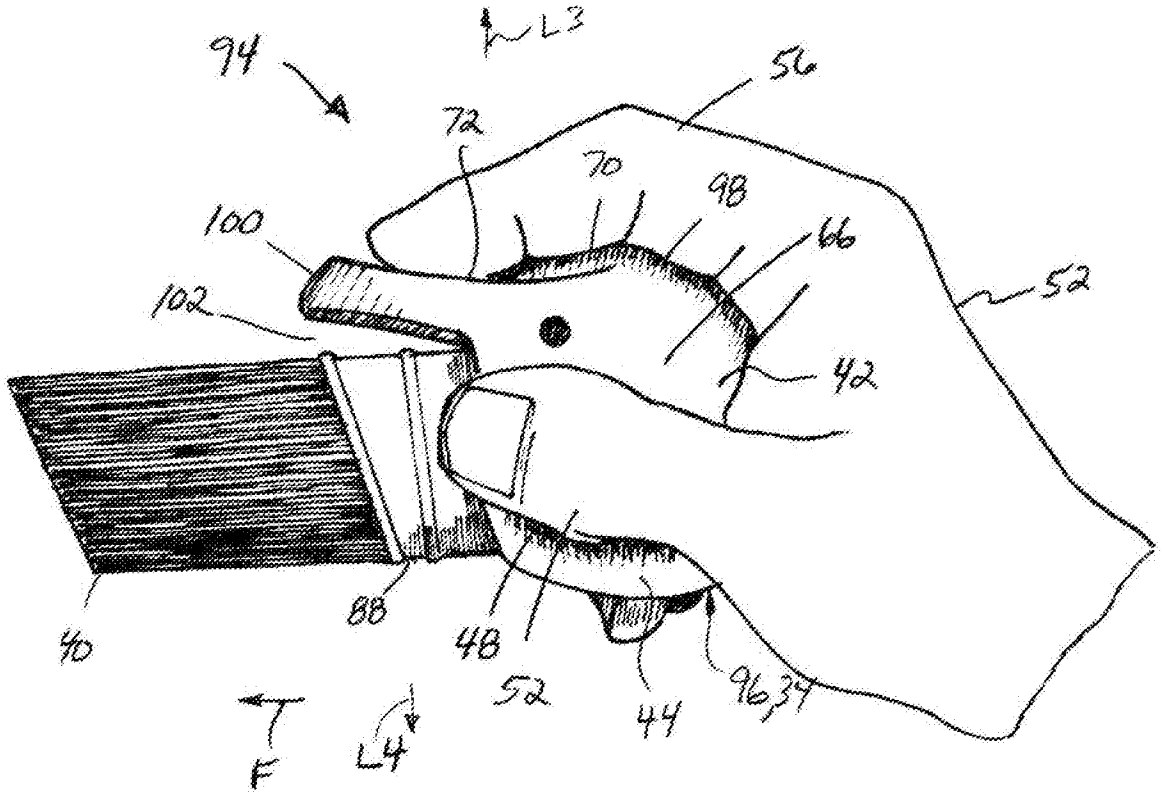
FIG. 18 is a side view of the brush, shown being held in one manner in a hand.
Figure 19:
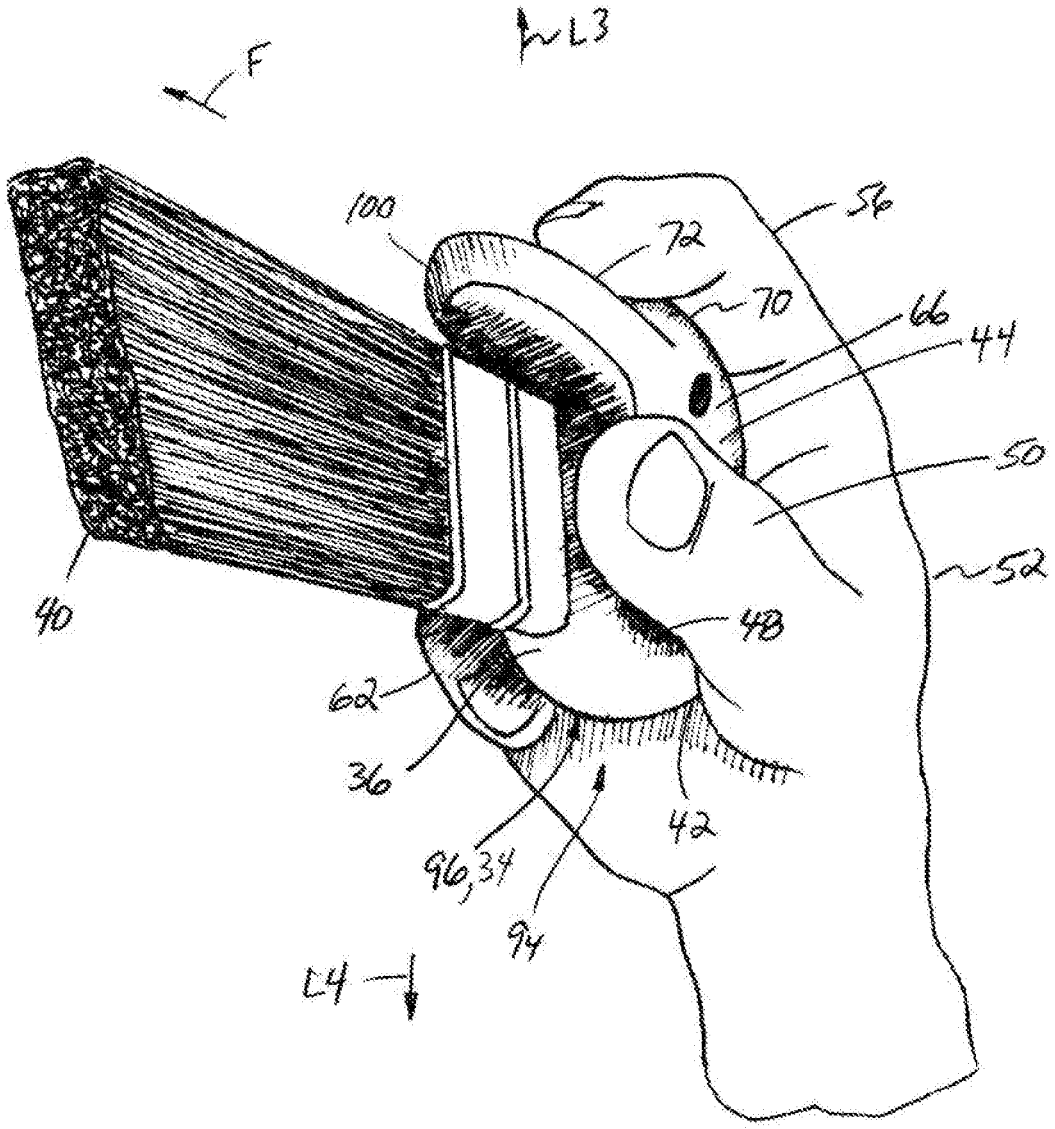
FIG. 19 is a perspective view of the brush, shown held in a hand.

By lengthwise conformance of the concavities with the thumb and finger or fingers, they will have a profile shape generally matching the palm side pad or pads of the thumb or finger when viewed from the side, particularly so as to receive the palm pad or pads of the thumb and fingers in conforming contact lengthwise for distributing loads and forces lengthwise along the thumb or finger, with the thumb and finger comfortably straight (but not rigid) or slightly bent, although if desired the concavity can be engaged by just the thumb tip or fingertip or tips, as illustrated in FIG. 11. In this regard, it should be noted that the concavities do not have to be long enough to receive the entire thumb or finger lengthwise, but in the instance of the thumb, that it preferred.

The concavities 48 and 54 are preferably defined by tapered surfaces 64, so as to generally have a wide dish shape, wider than the respective thumb or finger, in the case of the concavity 48, substantially wider, (e.g., see FIGS. 6A and 6B) to accommodate a range of sizes of thumbs in a range of positions sidewardly and angularly, as generally illustrated by crossed arrows on thumb 50 and the alternative positions of thumb 50 (see also FIGS. 7 and 8). FIG. 5 illustrates a depth D of concavity 48, which can range from about ¼ to a full thickness or more of a typical thumb from the palm side to the back side. Likewise FIGS. 6 and 6B best illustrate the depths of concavities 54.

Figure 6A:
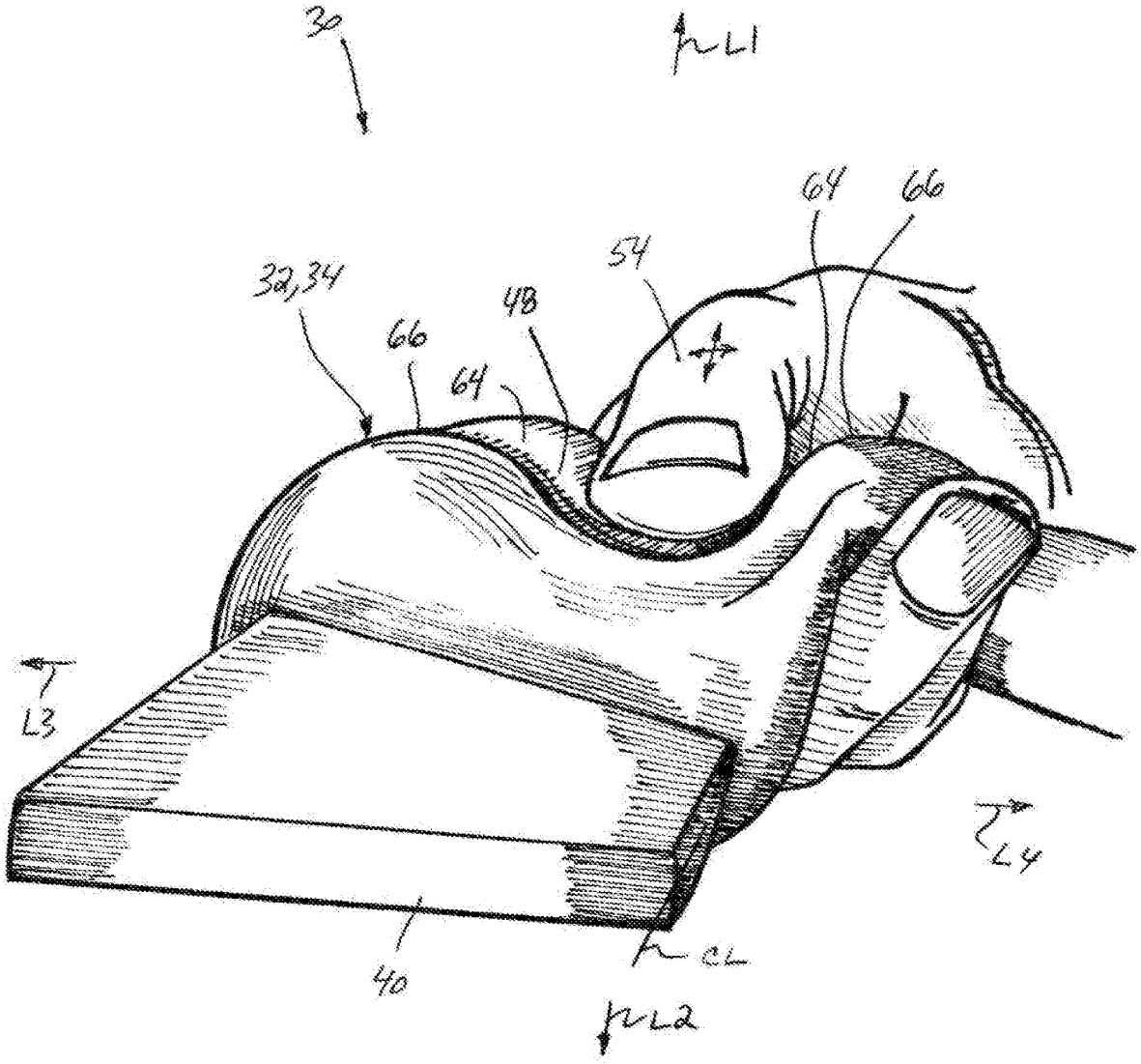
FIG. 6A is a fragmentary perspective view of the brush, showing engagement of a thumb with a surface of a concavity thereof for exerting forces to hold and/or move the brush.
Figure 6B:
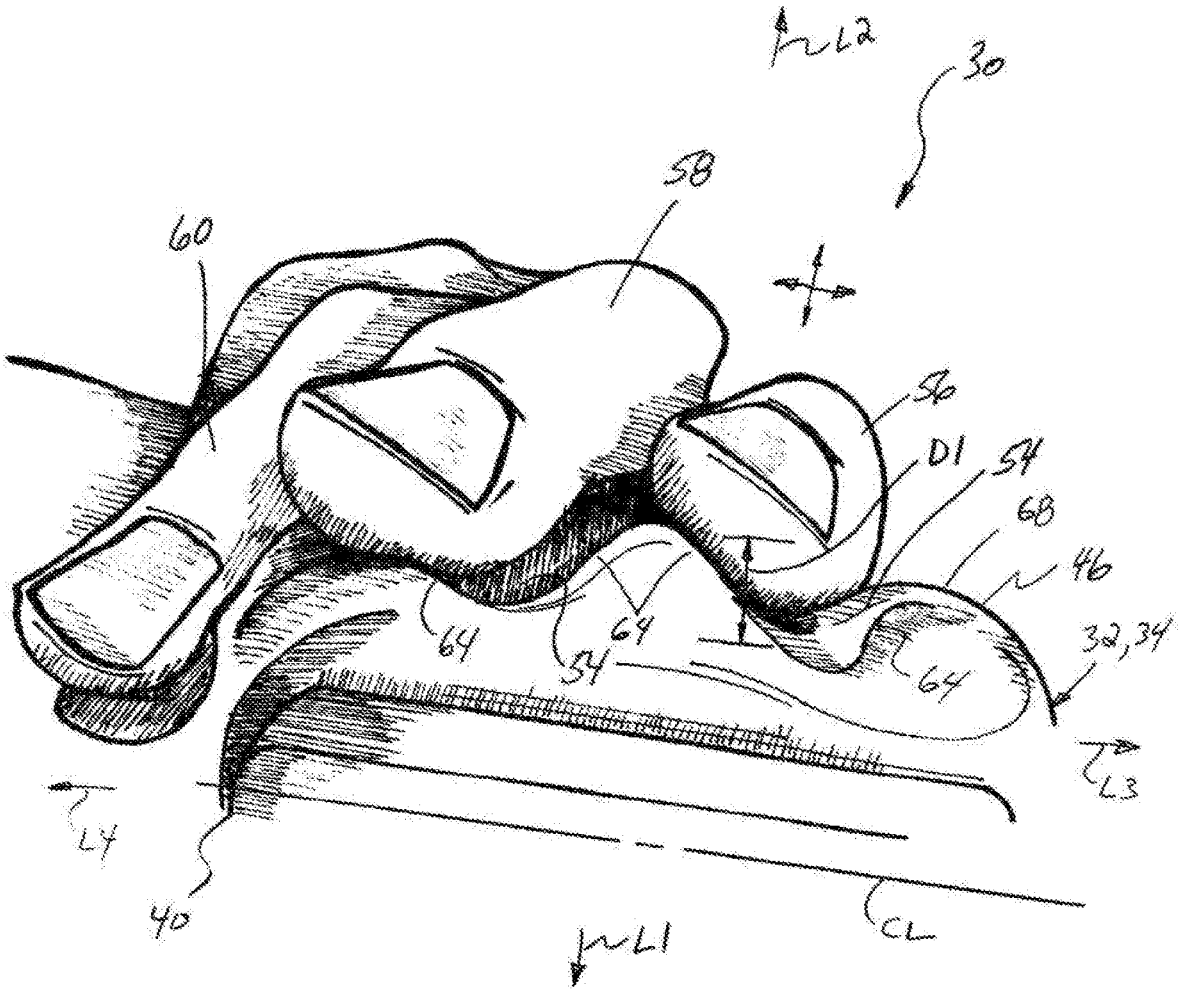
FIG. 6B is another fragmentary perspective view of the brush, showing engagement of fingers with surfaces of concavities thereof for exerting forces to hold and/or move the brush.

In the instance of both concavities 48 and 56, the surfaces 64 preferably extend outwardly of main body portion 34, terminating laterally outwardly in directions L1 and L2, at or on protuberances 66 and 68, respectively, certain of the protuberances 66 and 68 extending laterally outwardly in a third lateral direction L3, and a fourth lateral direction L4 opposite direction L3, between and angularly related to lateral directions L1 and L2. Here in various of the FIGS. it can be observed that the protrusions 66 and 68 are located laterally outwardly in associated directions L1, or L2, and direction L3 or direction L4, from a centerline CL of both mounting element 38 and utility object 40 by a substantial distance, D2 and D3, respectively. As a result, when a thumb or finger is pressed against the protuberance 66 or 68, a force moment is created about the utility object, to exert a mechanical advantage over the utility object 40 as a function of the applied force and the distance. As an example, this will be advantageous in the context of applying a coating or finish to a surface as a greater force can be exerted against the utility object 40, e.g., brush tip for moving the brush and for transferring the coating material to the surface. It can also be observed that the thumb and fingers can be pressed conformingly diagonally relative to the utility object, and that the applied forces can be directed correspondingly diagonally to the respective directions L1-L4, e.g., as best shown in FIGS. 6A and 6B, as well as have a component in the first direction F. As non-limiting examples, the distances D2 and D3 as illustrated in FIG. 6, can be about 1.5 times to 2 times or greater, than the thickness of the utility object, in each of the directions. This is also advantageous as it provides the desired moment (distance from location of contact of thumb or finger and applied force of utility object against a surface), and gives main body portion 34 an overall thickness between surfaces 44 and 46 about equal to that of a naturally cupped palm, between the heel of the thumb and the fingers. This size can be varied to fit different hand sizes, as desired or required.

Main body portion 34 includes a third lateral surface 70 between surfaces 44 and 46, and facing in third lateral direction L3. Surface 70 has a concavity 72 facing outward in third lateral direction L3, and is sufficiently large to receive at least a tip of another finger 56, 58, 60, or 62 of hand 52. At least a substantial portion of the concavities are bound and defined by gently sloped laterally outwardly facing surfaces 64 spaced laterally outwardly of mounting element 38 and thus utility object 40 mounted thereon, and extend onto protuberances 66 and 68, and against which the finger or fingers, or the thumb, of the hand when cupped or wrapped partially about the second end 42 can be pressed to exert a force with mechanical advantage over the utility object 40, which again can be, but is not limited to, a brush, scraper, cutter, or the like, in the above described manner.

The configuration of main body portion 34, including the location, size and configuration of concavities 48, 54, and 72, particularly the widely dished or gently tapered surfaces 64 of the concavities, allow positioning the thumb and finger or fingers in a range of sideward positions, and at different angles of contact, within the respective concavities, as best illustrated in FIGS. 6A and 6B, to enable varying the surfaces of the palm sides of the thumb and/or fingers used for contact, and the manner of contact in any selected position, and thus allow frequently varying the locations and manner of pressure and compression on the skin surfaces and joints, and also varying blood flow patterns within the thumb and fingers, all of which are believed to be key factors in relief or reduction of onset of stiffness, fatigue and/or pain. The shapes and locations of surfaces 64 are selected to also allow the thumb and fingers to be pressed more directly in directions of movement of a utility object, e.g., brush, that is, they face in directions at least generally opposite directions of movement, or in a diagonal direction between the direction of movement and a direction toward a surface onto which a coating or finish is to be applied, so that the pressure of the associated thumb and/or fingers will be directed both in the direction of movement and against the surface, and can be varied as desired or required, e.g., more toward the surface such as when transferring the coating thereto, and more toward the direction of movement, such as when spreading the coating on the surface.

Utility handle 32 additionally includes a protrusion or butt end portion 74 extending from second end 42 of main body portion 34, butt end portion 74 having a contoured shape including a concavity 76 shaped to receive a palm side 78 of a heel of the thumb 50, connecting with an open end 80 of first concavity 48 as best shown in FIG. 1, so as to essentially form an extension thereof. Concavity 76 wraps or expends about butt end portion 74 so as to accommodate and receive the palm side of hand 52 when wrapped about second end 42 of the main body portion, as variously illustrated, and for doing so has a depth from the surface of the main body portion about the same as the depth of the first concavity 48 as discussed above. An additional protuberance 66 is disposed adjacent to and bounding concavity 76, to afford a surface against which the larger heel 78 of the thumb can be pressed for additional support and exerting additional mechanical advantage against the utility object. Butt end portion 74 additionally is preferably configured to have an additional concavity 82, located and shaped to receive a palm side of a fourth finger 60, and/or a palm side of a fifth finger 62 of a hand when cupped or wrapped about main body portion 34, as best illustrated in FIG. 8 As non-limiting exemplary parameters, butt end portion 74 extends at between about an 80 degree angle and about a 120 degree angle to a longitudinal axis 84 extending in first direction F, as shown between axis 84 and an axis 86 through the butt end portion 74, imparting a generally overall L- or V-shape to handle 32, as best illustrated in FIG. 1. This has been found desirable as it permits supporting and carrying a portion of the weight of brush 30 between the heel 78 of thumb 50 and the heel of the hand and/or proximal portions of any or all of the fingers. This has been found to further distribute loads to other areas of the hand closer to the wrist.

Figure 3:
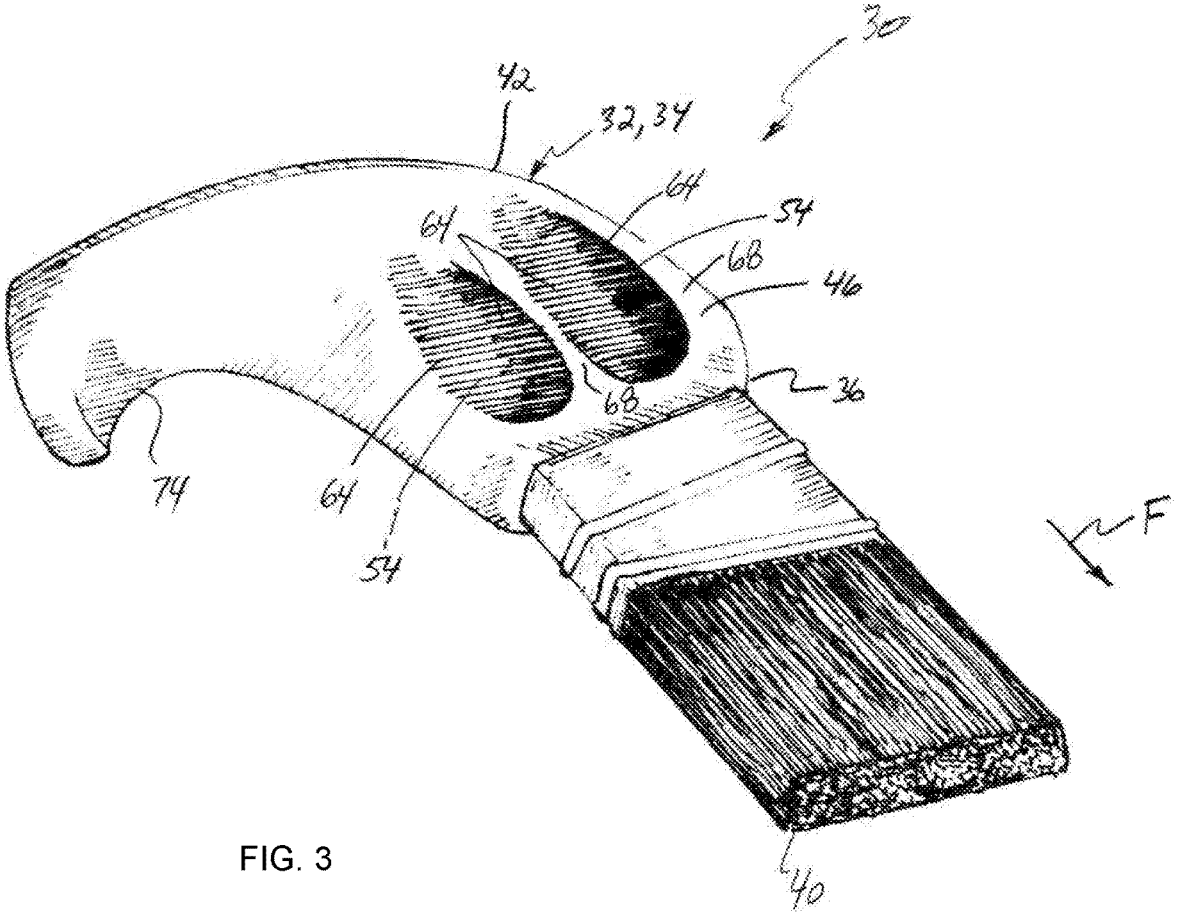
FIG. 3 is a perspective view of the brush.
Figure 3A:
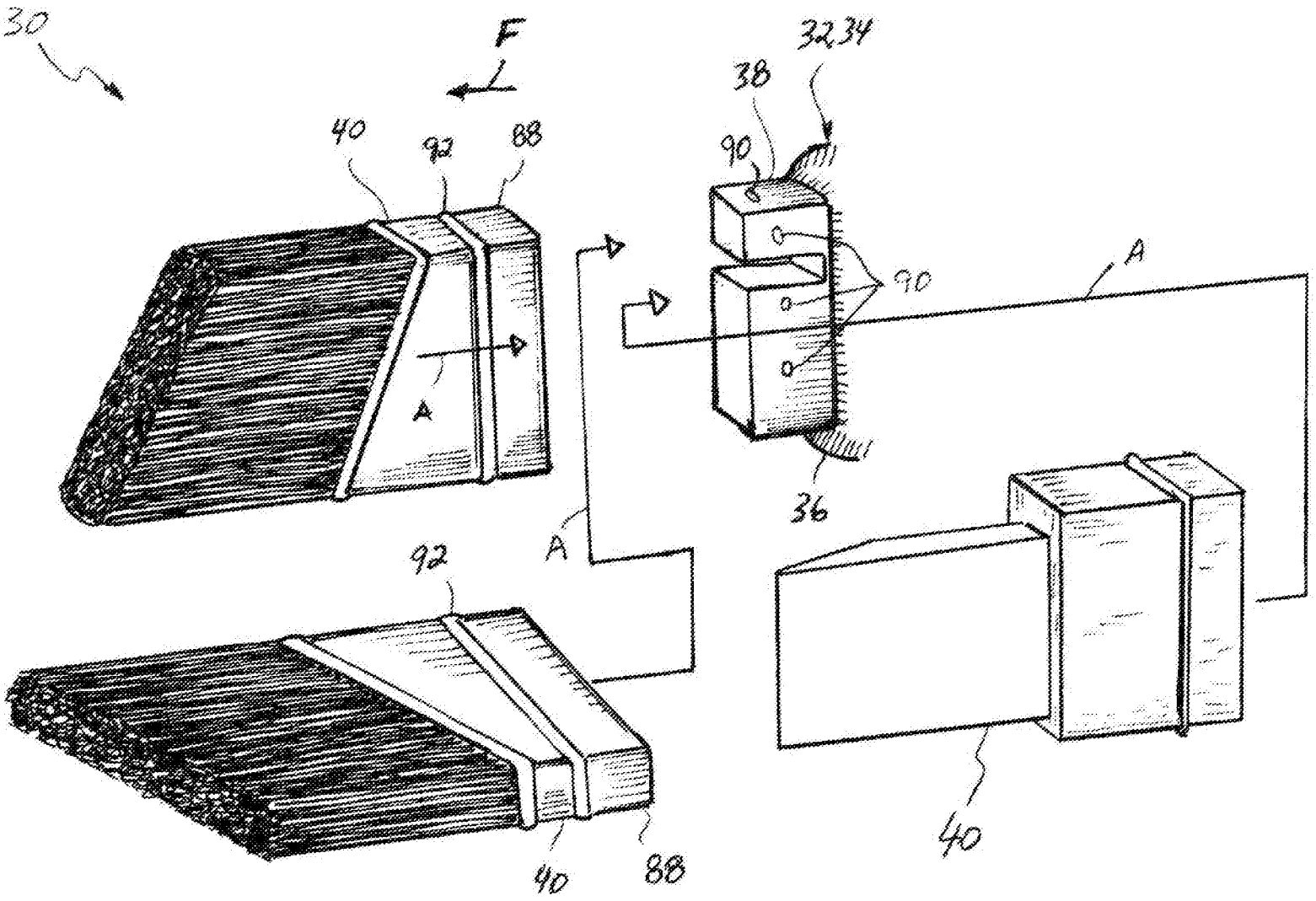
FIG. 3A is another perspective view of the brush, disassembled to show one manner of mounting a brush head to the handle.

As shown in FIG. 3A, first end 36 of main body portion 34 has a mounting element 38 extending in first direction F, including structure for securely mounting a utility object 40 thereon so as to also extend in first direction F. This can be a permanent mount, or removable in a convenient manner. Here, mounting element 38 is configured as a rectangular member sized and shaped to be securely received and held by friction and/or one or more mechanical detents 90, a fastener or fasteners, or the like, within a ferrule 88 of a utility object 40 embodying a brush head, including to be removable if desired, so as to be reinstallable in another manner as illustrated, including in a cross-wise configuration, and/or replaced. Ferrule 88 can for instance can be constructed of a thin sheet metal or plastics and include an external rib 92 thereabout forming an internal groove (not shown) positioned and sized to receive the detents 90. In a similar manner, a utility object 40 that is a different type or style of brush, a scraper, a knife, or cutter, or the like, can be installed either in a removable or permanent manner, as illustrated. As an advantage, when using a sash brush which has an angled tip (see also FIGS. 1 and 2) extending transversely and angled relative to the first direction, this feature makes it possible to remove and replace the brush head so as to reverse the direction of the angle as preferred by the user, including as many times as desired during a paint job such as when painting a window sash, door and/or jamb, and the like requiring positioning the brush at numerous angles. It also enables removing the brush head for easy replacement when worn or too tacky or dry, when changing colors, and also for storage in a sealed container when use is interrupted and to resume later. This is convenient to prevent drying of the paint or other coating carried on the brush, when the user desired to run an errand, change colors, allow a coating layer to dry, etc.

Referring also to FIGS. 12 through 21, another brush 30 for applying a variety of coatings, including, but not limited to, paints, varnishes, stains, shellacs, and the like, is shown including an embodiment of an ergonometric utility handle 96 constructed and operable according to the teachings of the invention, like parts of brush 94 and brush 30 being identified by like numerals. Ergonometric utility handle 96, like handle 32, has an ergonometric shape and size so as to be capable of being comfortably held in the hand for long periods of time and has an enhanced ability to support and exert motive forces against the brush, e.g. for transferring thick or viscous coatings or finishes onto a surface being coated, in a controlled manner.

Utility handle 96 includes a main body portion 34 having an overall three dimensional asymmetrical shape sized for being received and held in the palm of a partially cupped or folded hand 52 wrapped thereabout with the thumb 50 and fingers 56, 58, 60, and 62 of the hand generally extending in comfortable supported positions and orientations, toward a functional or first end 36, the palm, thumb, and fingers desirably arranged, not pinching it in just the thumb tip and fingertips and perhaps a small region of the palm as with prior known flat handles. First end 36 has a mounting element (see FIG. 3A) for mounting a utility object 40 thereon, which here is shown as a brush head, to extend outwardly in a first direction, denoted by arrow F.

Main body portion 34 has a generally bulbous shape second end 42 opposite first end 36 sized to generally conformingly fit in a partially cupped palm of a hand 50 of an intended user. Main body portion 34 has a first lateral surface 44 facing laterally outwardly in a first lateral direction L1, and a second lateral surface 46 facing oppositely of first lateral surface 44 in a second lateral direction L2 opposite the first lateral direction. Surfaces 44 and 46 are again asymmetrical, first lateral surface 44 including a first concavity 48 facing in the first lateral direction L1 and configured to receive the palm side of a thumb 50 of a hand 52 when cupped or wrapped about second end 42, in generally lengthwise conforming relation, as explained above. Second lateral surface 46 includes two elongate second concavities 54 facing in the second lateral direction L2 and configured to receive the palm side of a finger 56, 58, 60, or 62 respectively, of hand 52, so as to extend at least generally in the first direction F toward the utility object 40. Again, the concavities do not have to be long enough to receive the entire thumb or finger lengthwise.

The concavities 48 and 54 are defined by tapered surfaces 64, so as to generally have a wide dish shape, as also explained above to accommodate a range of sizes of thumbs and fingers in a range of positions sidewardly and angularly, concavities 54 for the fingers being narrower than concavity 48 for the thumb In the instance of both concavities 48 and 56, surfaces 64 preferably extend outwardly of main body portion 34, terminating laterally outwardly in directions L1 and L2, at or on protuberances 66 and 68 extending laterally outwardly in a third lateral direction L3, and a fourth lateral direction L4 opposite direction L3, respectively, the concavities having depths and distances from a centerline of main body portion 34 and being useable as explained above to exert a mechanical advantage over the utility object 40 as a function of the applied force and distance from the utility object.

Figure 21:
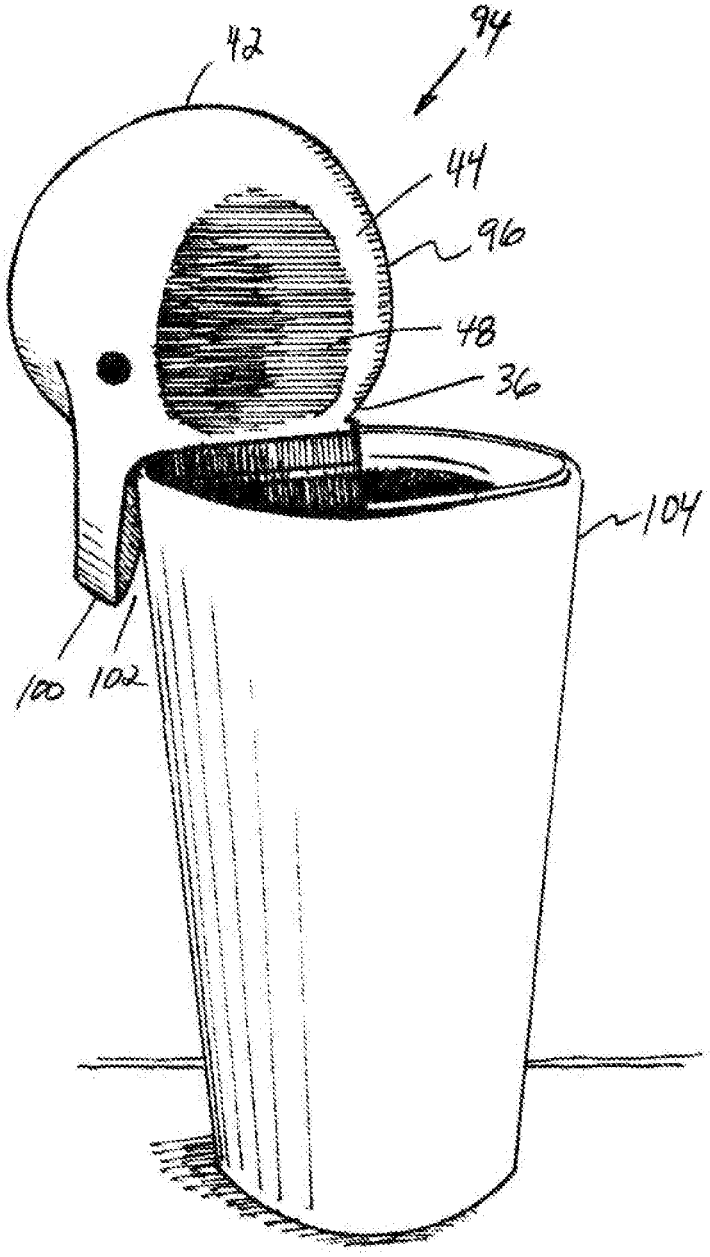
FIG. 21 is a side view of the brush, shown in one position self supported on the rim of a cup.

Main body portion 34 includes a third lateral surface 70 between surfaces 44 and 46, and facing in third lateral direction L3. Surface 70 has a concavity 72 facing outward in third lateral direction L3, and is sufficiently large to receive at least a tip of another finger 56, 58, 60, or 62 of hand 52. Concavity 72 here is located forwardly of a protuberance 98 on main body portion 34, on a cantilever extension 100 extending therefrom generally in first direction F, in spaced, generally parallel relation to utility object 40. Here, it can be observed that cantilever extension 100 is spaced from ferrule 88, bounding and defining a gap 102 therebetween configured to receive an edge or lip of a paint bucket, cup or other container 104 for hanging the brush or other utility object, as illustrated in FIG. 21. This arrangement allows placement of a desired finger or fingers, or the thumb, on extension 100, closer to the application of the coating, for more precise control, as desired.

Again, concavity 72 is bound and defined by gently sloped laterally outwardly facing surfaces 64 spaced laterally outwardly of the mounting element and utility object 40 mounted thereon, so as to extend onto protuberances 66 and 68 as well as the periphery of the extension 100. This allows and facilitates pressing of the finger or fingers, or the thumb, in a manner to exert a force with mechanical advantage over the utility object 40, in the above described manner.

Protuberance 98 has an overall curved convex shape so as to be configured to comfortably support the palm surface of the distal portion of the associated finger, e.g., finger 56 or 58, so as to be oriented to extend generally in first direction F, and in a manner for that or another finger to support and guide movements of the brush, particularly for effecting precision movements of the brush tip. This finger can also be used to support the brush when laden with heavy paint. This imparts an overall round shape to the main body portion when viewed from lateral directions L1 and L2, which has been found to be comfortable to hold in the hand for long periods of time.

Figure 22:
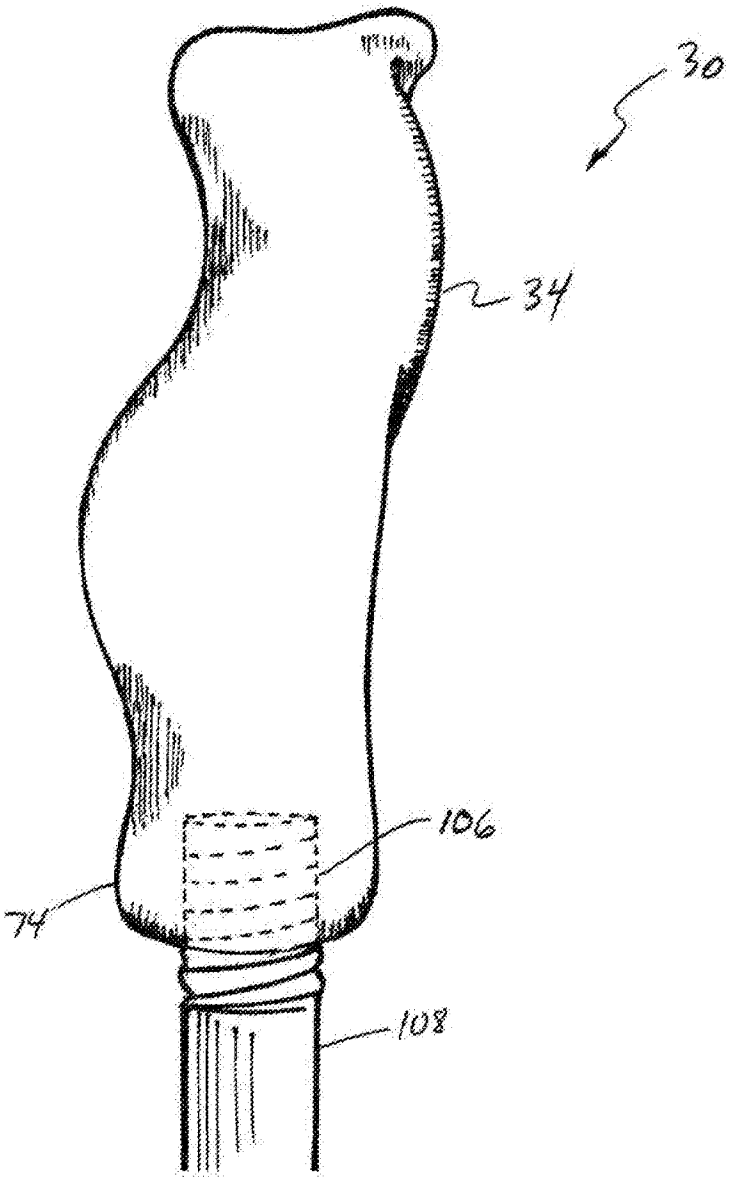
FIG. 22 is an end view of an embodiment of the brush, showing attachment of an extension pole thereto.
Figure 23:
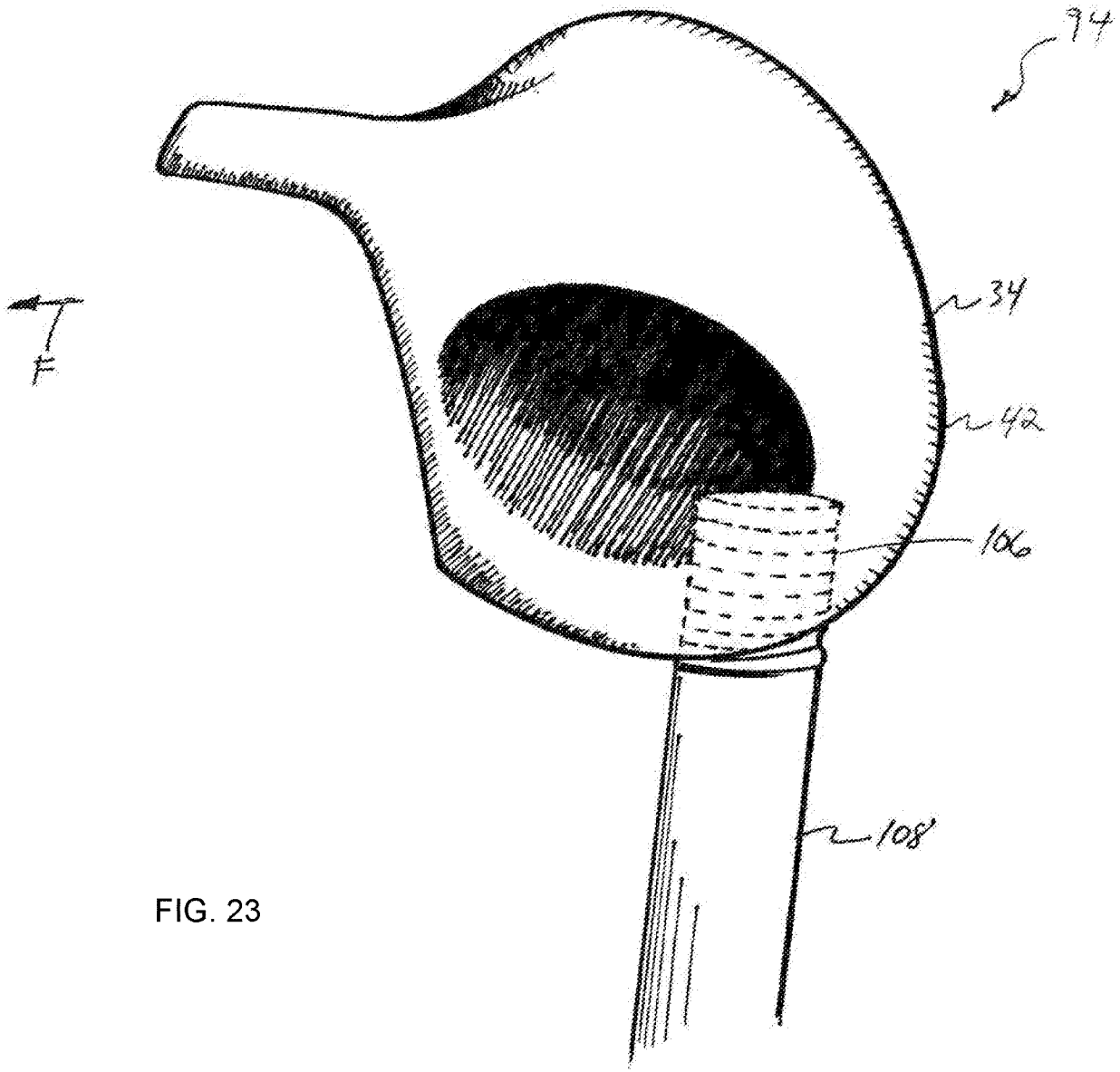
FIG. 23 is a side view of another embodiment of the brush, showing attachment of an extension pole.

Referring also to FIGS. 22 and 23, as an option, the handles 30 and 94 of the invention can include one or more internally threaded apertures 106 configured for threadedly receiving a male threaded end of an extension pole 108 having a desired length, to allow use of the handle 30 or 94 for applying coatings to normally out of reach surfaces, such as upper regions of walls and ceilings. As non-limiting examples, the main body portion 34 can include a threaded aperture 106 in the second end 42 thereof, the butt end portion 74, such that an extension pole can be attached to the handle and extend therefrom at a desired angle, such as oppositely or generally perpendicular to or at another large acute angle or small obtuse angle to first direction F, sidewardly or laterally (directions L1 or L2), as desired or required for a particular application. In any instance, the extension pole 108 can be used when desired and removed when not needed.

As a variation, referring again to FIG. 13 and various of the subsequent FIGS. showing hand and finger positions, utility handle 96 can include a main body portion 34 having an overall three dimensional but symmetrical shape sized the same as discussed above. In this variant, second lateral surface 46 will be at least largely a mirror image of first lateral surface 44 (FIG. 13) and second end 42 will have a generally bulbous shape sized to generally conformingly fit in a partially cupped palm of a hand 50 of an intended user. In this embodiment, both first surface 44 and second surface 46 will include a concavity 48, concavity 48 of first surface 44 being configured to receive the palm side of a thumb 50 of a hand 52 when cupped or wrapped about second end 42, and concavity 48 of second surface 46 will be configured to receive the palm side of a finger or fingers 56, 58, 60, or 62 respectively, of hand 52, such that the thumb and finger or fingers extend at least generally in the first direction F toward the utility object 40. Again, the concavities 48 do not have to be long enough to receive the entire thumb or finger lengthwise.

As still another variant, the main body portion 34 of a handle 30 or 94 can be at least partially resiliently yieldable so as to be squeezably deformed to a limited extent by application of thumb and finger pressure in a pinching direction or manner pinching surfaces 44, 46 toward each other. This can be accomplished by molding or casting body portion 34 of a compressible material such as a foamed rubber or polymer, and/or manufacturing it to be hollow or have an internal cavity in a selected region, e.g., bulbous second end 42, for comfort and more secure holding.

In light of all the foregoing, it should thus be apparent to those skilled in the art that there has been shown and described an ergonometric utility handle according to the invention. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A utility handle, comprising:

a main body portion having a first end including a mounting element for mounting a utility object extending outwardly in a first direction, and a second end opposite the first end having a bulbous shape having a size to be received in a palm of a hand cupped or wrapped partially thereabout;

the main body portion having opposite first and second lateral surfaces and a third lateral surface between and angularly related to the first and second lateral surfaces, the lateral surfaces extending from about the first end to about the second end, the first lateral surface including a concavity facing outward in a first lateral direction relative to the first direction and open to the second end and configured to lengthwise receive a palm side of a thumb of a hand cupped or wrapped about the second end, the second lateral surface including at least one concavity facing outward in a second lateral direction opposite the first lateral direction and extending longitudinally toward the first end, configured to lengthwise receive a palm side of a finger of the hand cupped or wrapped about the second end, and the third lateral surface facing outward in a third lateral direction angularly related to the first and second lateral directions and being sufficiently large to receive at least a tip of another finger of the hand, and wherein the first lateral surface and the third lateral surface include surfaces spaced laterally outwardly of the mounting element by a distance equal to or greater than a thickness of the mounting element in the first and second lateral directions and disposed on a protuberance extending diagonally outwardly relative to the mounting element.

2. The utility handle of claim 1, wherein the concavity of the first lateral surface includes a concave portion that curves about the second end to receive a palm side of a heel of the thumb of the hand when cupped or wrapped partially about the second end.

3. The utility handle of claim 1, wherein the second lateral surface comprises two of the concavities.

4. The utility handle of claim 1, wherein the third lateral surface includes a concavity located on a cantilever extension of the main body portion extending in the first direction therefrom.

5. The utility handle of claim 1, wherein the third lateral surface has a protuberance extending laterally therefrom between the concavity thereof and the second end.

6. The utility handle of claim 1, further comprising a butt end portion extending from the second end of the main body portion at an acute angle to the first direction of between about 80 and about 130 degrees, and against which a heel of the palm of the hand when cupped or wrapped about the second end can be pressed.

7. The utility handle of claim 1, wherein the second lateral surface comprises two of the concavities narrower than the concavity of the first lateral surface.

8. The utility handle of claim 1, wherein the utility object comprises a brush.

9. The utility handle of claim 1, wherein the brush has an angled edge, and the mounting element is configured to cooperatively receive and retain a ferrule of the brush in overlaying relation thereto in at least two alternative orientations to allow orienting the angled edge in two directions, respectively.

10. The utility handle of claim 1, wherein the main body portion comprises at least one internally threaded hole configured to threadedly receive an extension pole in outwardly extending relation thereto.

11. The utility handle of claim 1, wherein the main body portion has a rounded overall shape when viewed from the first lateral direction and the second lateral direction, respectively.

12. A brush, comprising:

a main body portion having a first end including a brush head extending outwardly in a first direction therefrom, an opposite second end, and a plurality of angularly related surfaces extending between the first end and the second end, respectively, including:

i. a first lateral surface facing outwardly in a first lateral direction relative to the first direction and having a concavity therein having a size and a shape to receive a palm side of a thumb;

ii. a second lateral surface facing outwardly in a second lateral direction opposite the first lateral direction and having at least one concavity therein having a shape to lengthwise receive a palm side of a finger; and a third lateral surface having a bulbous portion disposed between and narrower than the first and second lateral surfaces and a concave portion located on a cantilever extension of the main body portion extending in the first direction therefrom generally beside and spaced from the brush head, the concave portion having a size and a shape to receive a palm side of a distal end of another finger, wherein the main body portion comprises a protuberance projecting laterally diagonally outwardly between the first and third lateral surfaces.

13. The brush of claim 12, wherein the at least one concavity of the second lateral surface and the concave portion of the third lateral surface are elongate and extend longitudinally in the first direction.

14. The brush of claim 12, wherein the second end of the main body portion has a rounded profile shape when viewed from the first and second lateral directions, respectively.

15. The brush of claim 12, further comprising a butt end portion extending from the second end of the main body portion, the butt end portion having a concavity extending circumferentially thereabout connecting at one end to the concavity of the first lateral surface and having a size and a shape to receive a palm side of a heel of a thumb received in the concavity of the first lateral surface.

16. The brush of claim 12, wherein the main body portion comprises an internally threaded hole configured to threadedly receive an extension pole in outwardly extending relation thereto.

17. The brush of claim 12, wherein the second lateral surface comprises two of the concavities smaller than the concavity of the first lateral surface.

18. The brush of claim 12, wherein the brush head comprises a ferrule having a predetermined extent in the first direction from the main body portion, and the cantilever extension of the main body portion has an extent in the first direction marginally less than the extent of the ferrule and is laterally spaced therefrom by an amount to receive an edge or lip of a paint pail or bucket therebetween for hanging the brush thereon.

19. The brush of claim 12, wherein the brush head comprises a brush portion having a brush end cut at an angle relative to the first direction, and the brush head is removable and replaceable in an opposite manner on the main body portion to allow reversing a direction of the angle.

20. An ergonometric brush, comprising:

a handle including a main body portion having a bulbous shape and a size configured to occupy a space bounded by a hand cupped or wrapped thereabout;

a brush ferrule extending in a first direction from a first end of the main body portion, the brush ferrule holding a coating applying element so as to extend further in the first direction therefrom;

the main body portion having opposite first and second lateral surfaces facing in opposite first and second lateral directions relative to the first direction, respectively, the first and second lateral surfaces including an arrangement of widely dished concavities therein facing laterally outwardly in the opposite lateral directions, respectively, the concavities being positioned and having shapes configured to receive lengthwise palm sides of a thumb and at least one finger, respectively, of the hand when cupped or wrapped about the main body portion, and a third lateral surface including a concavity facing outward in a third lateral direction angularly related to the first and second lateral directions and being sufficiently large to receive at least a tip of another finger of the hand, at least portions of the concavities being disposed on a protuberance extending diagonally outwardly relative to the brush ferrule and bound and defined by gently sloped laterally outwardly facing surfaces spaced laterally outwardly of the mounting element.

* * * * *